US006533560B2

(12) United States Patent
Ohya et al.

(10) Patent No.: US 6,533,560 B2
(45) Date of Patent: Mar. 18, 2003

(54) ELECTROMAGNETIC OSCILLATING TYPE PUMP AND METHOD FOR MANUFACTURING THE SAME

(75) Inventors: Ikuo Ohya, Takatsuki (JP); Nozomu Kawasaki, Takatsuki (JP)

(73) Assignee: Techno Takatsuki Co., Ltd., Osaka-fu (JP)

( * ) Notice: Subject to any disclaimer, the term of this patent is extended or adjusted under 35 U.S.C. 154(b) by 0 days.

(21) Appl. No.: 09/753,156

(22) Filed: Jan. 2, 2001

(65) Prior Publication Data

US 2001/0008608 A1 Jul. 19, 2001

(30) Foreign Application Priority Data

| | | |
|---|---|---|
| Jan. 6, 2000 | (JP) | 2000-001006 |
| Jul. 27, 2000 | (JP) | 2000-227302 |
| Oct. 27, 2000 | (JP) | 2000-328537 |

(51) Int. Cl.[7] ..... F04B 39/00; F04B 39/10
(52) U.S. Cl. ..... 417/431.1; 417/312; 417/534
(58) Field of Search ..... 417/431.1, 312, 417/534, 536, 537, 535

(56) References Cited

U.S. PATENT DOCUMENTS

| | | | | |
|---|---|---|---|---|
| 3,515,966 A | * | 6/1970 | De Valroger et al. | 310/17 |
| 4,859,152 A | * | 8/1989 | Kimura et al. | 417/360 |
| 4,877,378 A | * | 10/1989 | Saggers | 471/299 |
| 4,988,268 A | * | 1/1991 | Kurihara | 181/246 |
| 5,011,379 A | * | 4/1991 | Hashimoto | 417/360 |
| 5,104,298 A | * | 4/1992 | Takahashi et al. | 310/17 |
| 5,779,455 A | * | 7/1998 | Steiger | 267/161 |

* cited by examiner

*Primary Examiner*—Charles G. Freay
*Assistant Examiner*—Timothy P. Solak
(74) *Attorney, Agent, or Firm*—Ware, Fressola, Van Der Sluys & Adolphson LLP

(57) ABSTRACT

An electromagnetic oscillating type pump for oscillating diaphragms (5) connected to an oscillator (4) caused to oscillate by utilizing magnetic interaction between an electromagnetic portion (2) and a magnetic body (3), and having a frame portion (19 51 74 83) of resin mold formed by molding resin on an outer surface of the electromagnetic portion (2). For positioning iron cores (20 82) provided as part of the electromagnetic portion (2), an iron core positioning tool (18) is optionally provided, and in some embodiments is included as part of the electromagnetic portion (2) and disposed at an inner peripheral portion of the electromagnetic portion (2).

14 Claims, 33 Drawing Sheets

ELECTROMAGNETIC OSCILLATING TYPE PUMP AND METHOD FOR MANUFACTURING THE SAME

BACKGROUND OF THE INVENTION

1. Techincal Field

The present invention relates to an electromagnetic oscillating type pump and a method for manufacturing the same. More particularly, the present invention relates to an electromagnetic oscillating type pump which is mainly utilized for suction and discharge of air of indoor type air mattresses or airbeds, for supplying oxygen to fish-farming aquariums or purifying tanks for domestic use as well as for sampling gas for examination purposes in monitoring pollution.

2. Discussion of Related Art

An example of a conventionally known electromagnetic oscillating type pump is a diaphragm type pump as illustrated in FIG. 39 which utilizes magnetic interaction between electromagnets and permanent magnets wherein suction and discharge of fluid is performed by utilizing oscillating force of an oscillator provided with such permanent magnets.

This pump comprises an electromagnetic portion composed of electromagnets 151 disposed as to oppose each other, an oscillator 153 having permanent magnets 152, diaphragms 154 connected to both ends of the oscillator 153, diaphragm bases 154*a* and pump casings 155 respectively fixed to both end sides of the electromagnetic portion, and a pump compressing chamber 156 formed between the diaphragm 154 and the pump casing 155. Each electromagnet 151 is assembled by installing a wound coil portion 158 around an E-shaped iron core 157, and the oscillator 153 is disposed in a clearance portion 159 formed between the iron cores 157.

Suction and discharge of air is performed in an alternating manner on the right and left of the pump, being affected by changes in capacity of the pump compressing chamber 156 to increase and decrease contrarily on the right and left owing to oscillation of the oscillator 153 supported by the diaphragms 154.

However, there is presented a drawback with such a conventional type pump that it is difficult to secure a specified dimension for the clearance portion at the time of assembling the electromagnetic portion since specified positions for the iron cores are shifted. It is also quite costly when housing the pump in a separate sound isolating case to insulate noise arising from the pump portions. It is also difficult to improve productivity since three parts, namely the electromagnetic portion, the diaphragm base and the pump casing, need to be assembled.

An alternative pump is a pump as illustrated in FIG. 40 comprising two sets of casings 203, 204 for supporting a diaphragm 201 while forming a pump chamber 202, an oscillator 205 connected to the diaphragm 201, an electromagnetic portion 207 comprising electromagnets 206, a filter holding portion 208, and an air tank 209. A cylindrical body 210 is attached between the casings 203, 204 by means of screws 210*a*, and a pump main body 211 is formed by accommodating the electromagnetic portion 207 in the cylindrical body. The pump main body 211 is accommodated in a housing 212 with the filter holding portion 208 being fitted into an upper portion of the housing 212 while the air tank 209 is attached to its lower portion by means of screws 212*a*.

This pump also utilizes forced oscillation of the diaphragm 201 so that the pump main body 211 itself is oscillated and thus generates a large noise. Therefore, it has been devised to support the pump main body 211 at the air tank 209 through four stepped cushions 213 to thereby absorb oscillation within the housing 212.

However, this arrangement of making the pump main body 211 be supported at the air tank 209 by the four stepped cushions 213 makes it troublesome to mount the pump main body 211, and it is still difficult to satisfactorily absorb the oscillation. There are further presented drawbacks that the housing 212 becomes large-sized in contrast to the pump main body, and that it is difficult to reduce manufacturing cost because the cost for the housing is most expensive among utilized parts.

The present invention has been made in view of the above facts, and it is an object thereof to provide an electromagnetic oscillating type pump exhibiting high acoustic insulating effects while reducing manufacturing costs.

SUMMARY OF THE INVENTION

In accordance with the present invention, there is provided an electromagnetic oscillating type pump for oscillating diaphragms connected to an oscillator through electromagnetic oscillation of the oscillator with magnetic body by utilizing magnetic interaction between an electromagnetic portion comprising one or a plurality of iron cores and the magnetic body, wherein a frame portion of resin mold is formed by molding resin on an outer surface of the electromagnetic portion.

The electromagnetic oscillating type pump of the present invention is further so arranged that an oscillator formed with a piston is employed in place of the oscillator to which the diaphragms are connected, and that it further comprises a cylinder portion integrally formed with the electromagnetic portion in place of a mounting portion for the diaphragms.

In accordance with the present invention, there is further provided a method for manufacturing an electromagnetic oscillating type pump for oscillating diaphragms connected to an oscillator through electromagnetic oscillation of the oscillator with magnetic body by utilizing magnetic interaction between an electromagnetic portion comprising one or a plurality of iron cores and the magnetic body, wherein the method comprises the steps of assembling the electromagnetic portion by fitting the iron cores forming the electromagnetic portion into a periphery of an iron core positioning tool, disposing the assembled electromagnetic portion into dies with an angular core for insertion formed at a concaved central portion thereof, and injecting resin into a cavity of the dies for molding the resin on an outer surface of the electromagnetic portion.

In accordance with the present invention, there is also provided a method for manufacturing an electromagnetic oscillating type pump for oscillating diaphragms connected to an oscillator through electromagnetic oscillation of the oscillator with magnetic body by utilizing magnetic interaction between an electromagnetic portion comprising one or a plurality of iron cores and the magnetic body, wherein the method comprises the steps of assembling the electromagnetic portion by placing the iron cores forming the electromagnetic portion to a periphery of an iron core positioning tool obtained by adhering soft magnetic bodies with a magnet pinched therebetween, disposing the assembled electromagnetic portion into dies, injecting resin into a cavity of the dies for molding the resin on an outer surface of the electromagnetic portion, and detaching the iron core positioning tool upon completion of molding.

In accordance with the present invention, there is still further provided a method for manufacturing an electromagnetic oscillating type pump for oscillating diaphragms connected to an oscillator through electromagnetic oscillation of the oscillator with magnetic body by utilizing magnetic interaction between an electromagnetic portion comprising one or a plurality of iron cores and the magnetic body, wherein the method comprises the steps of disposing, upon assembly of the electromagnetic portion, the assembled electromagnetic portion into dies with an angular core for insertion formed at a concaved central portion thereof, positioning and fixing the iron cores to the angular core for insertion through a magnetic attraction by applying power to the electromagnetic portion, and injecting resin into a cavity of the dies for molding the resin on an outer surface of the electromagnetic portion.

The method for manufacturing the electromagnetic oscillating type pump of the present invention utilizes an oscillator formed with a piston in place of the oscillator to which the diaphragms are connected, and further comprises a cylinder portion integrally formed with the electromagnetic portion in place of a mounting portion for the diaphragms.

DETAILED DESCRIPTION

The electromagnetic oscillating type pumps and the method for manufacturing the same according to the present invention will now be explained with reference to the accompanying drawings.

Figure 1:
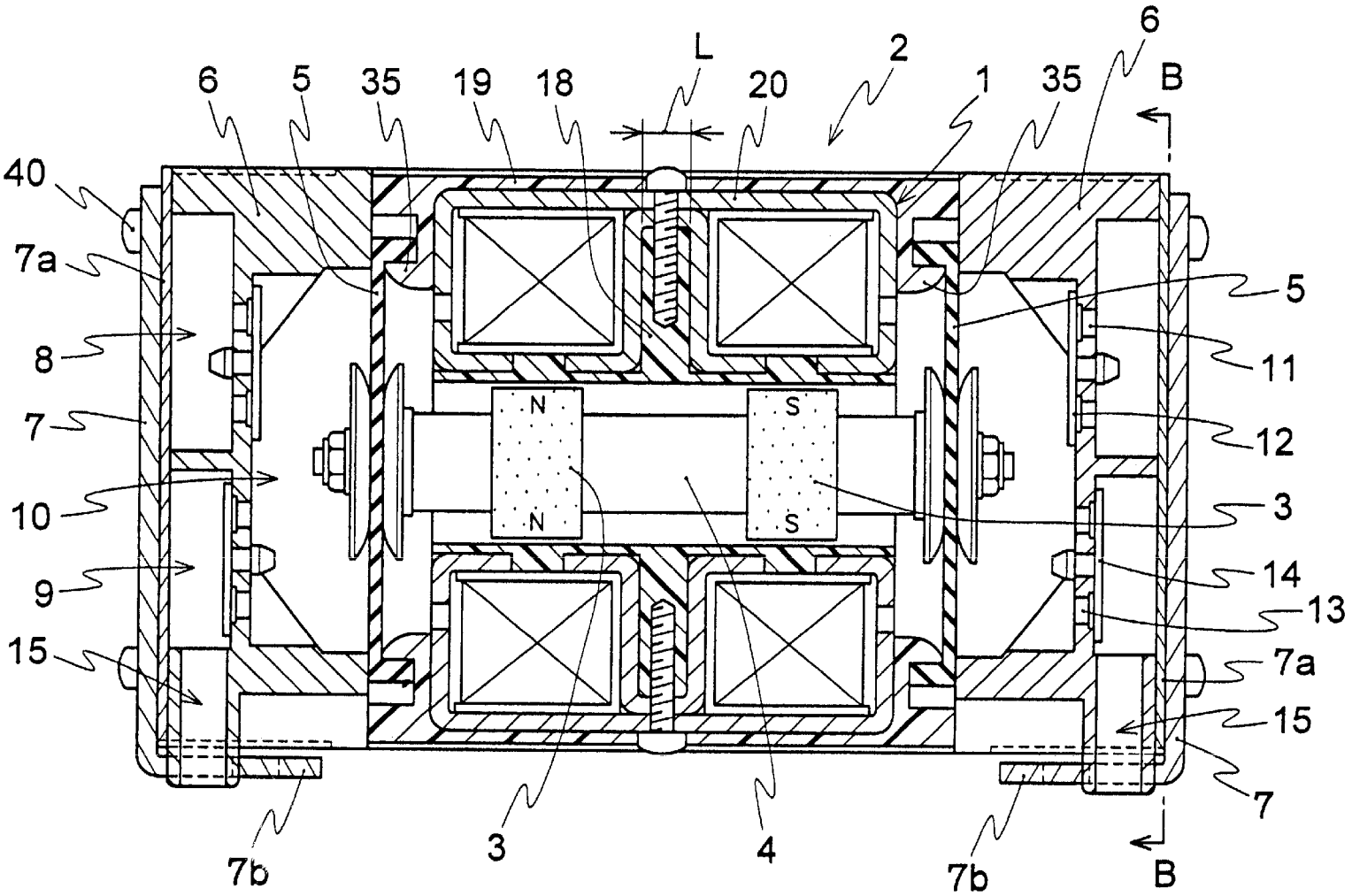
FIG. 1 is a longitudinal sectional view showing one embodiment of an electromagnetic oscillating type pump according to the present invention.
Figure 2:
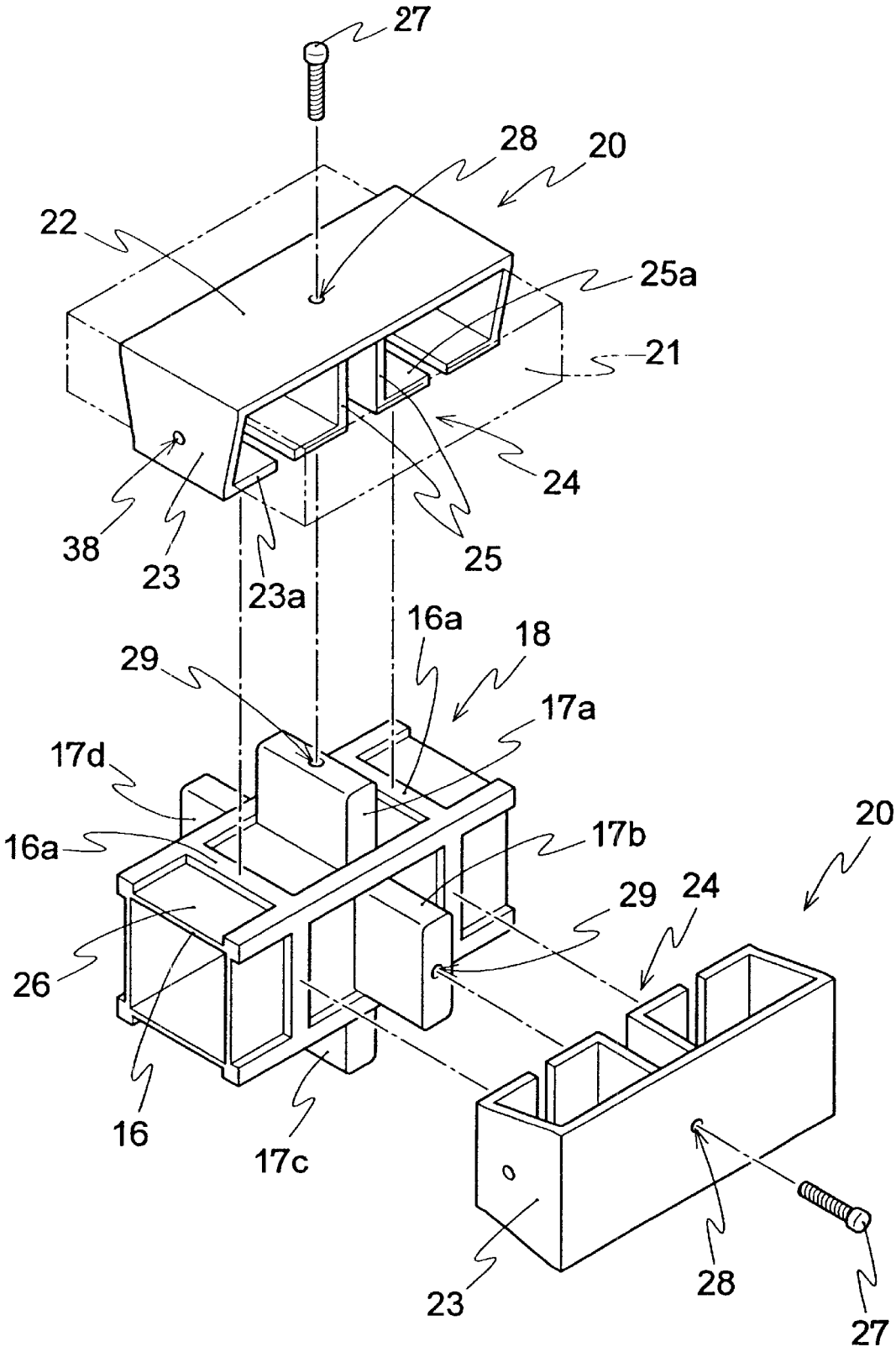
FIG. 2 is a perspective view showing an assembly of an iron core positioning tool and iron cores in the present invention.
Figure 4:
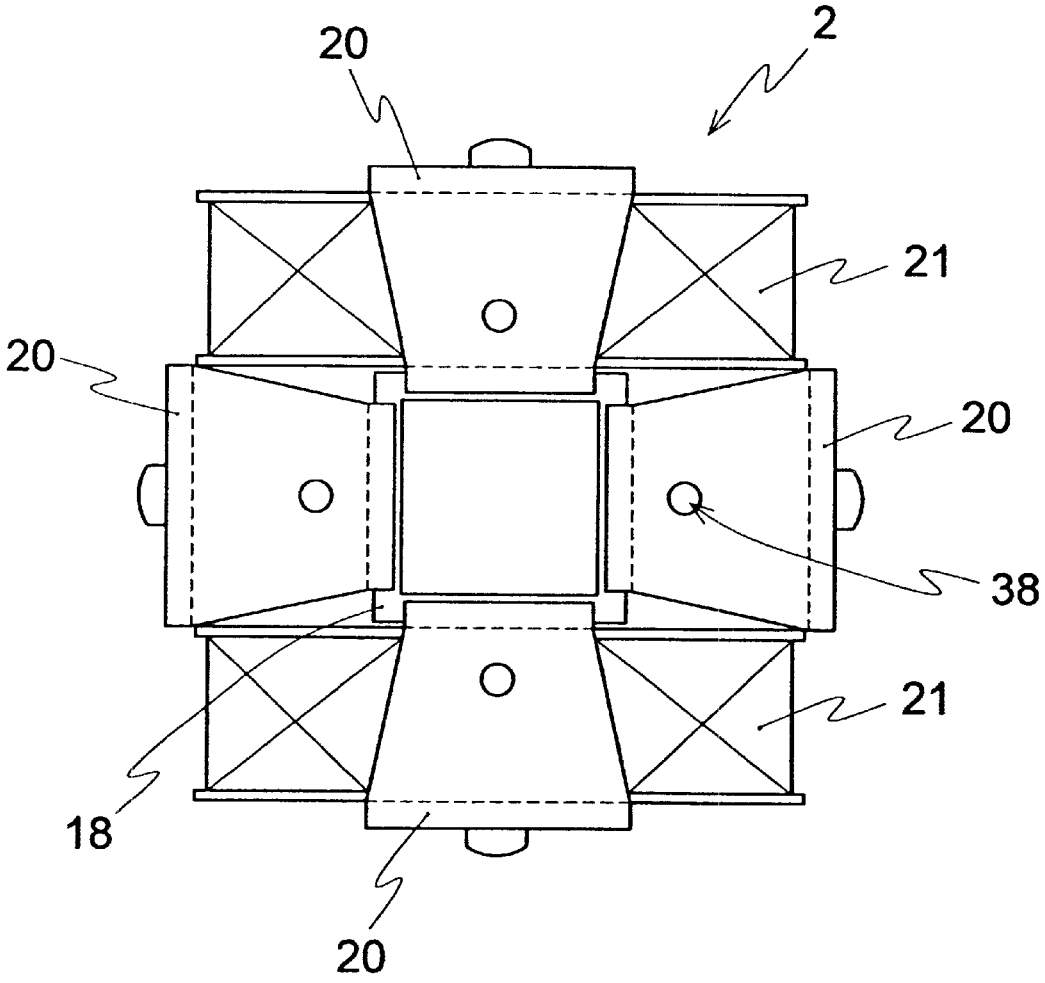
FIG. 4 is a longitudinal sectional view of the iron core positioning tool and the iron cores upon completion of assembly.

As illustrated in FIGS. 1, 2 and 4, the electromagnetic oscillating type pump according to one embodiment of the present invention comprises an electromagnetic portion 2 formed by a pair of electromagnets 1 disposed as to oppose each other and a pair of iron cores 20 that will be described later, an oscillator 4 with permanent magnets 3 such as ferrite magnets or rare-earth magnets which is disposed in a clearance portion formed between the electromagnets 1 with a specified distance being formed therebetween, diaphragms 5 connected to both ends of the oscillator 4, and pump casings 6 which are respectively fixed to both end portions of the electromagnetic portion 2, wherein lateral surface lids (valve chamber lids) 7 are fixedly attached to lateral surface sides of pump portions of the pump casings 6 with packings 7*a* being pinched therebetween. The lateral surface lids 7 are made of metallic material and exhibit high acoustic insulating characteristics (sound isolating characteristics). A mounting leg 7*b* is integrally formed with each of the lateral surface lid 7 for enabling easy mounting to a mounting portion. Each pump casing 6 includes a pump portion comprising a suction chamber 8, a discharge chamber 9 and a compressing chamber 10 wherein the suction chamber 8 has a suction port 11 and a suction valve 12 and the discharge chamber 9 a discharge port 13 and a discharge valve 14, respectively for communication with the compressing chamber 10. With this arrangement, it is enabled to oscillate diaphragms 5 connected to the oscillator 4 by utilizing magnetic interaction between the electromagnets 1 and the permanent magnets 3 such that after suction of external air, the air can be discharged through a discharge nozzle portion 15.

Each permanent magnet 3 is so arranged that its external shape with which it is directly attached to a shaft is angularly formed (to be of prism type). Of the pair of permanent magnets 3, one permanent magnet 3 is magnetized at four portions in a peripheral direction such that the polarities of N-pole and S-pole are alternately made to assume anisotropic magnetic poles while the other permanent magnet 3 is magnetized at four portions in a peripheral direction such that the polarities of N-pole and S-pole are alternately made to assume anisotropic magnetic poles which are reverse to those of the opposing permanent magnet 3.

Figure 3:
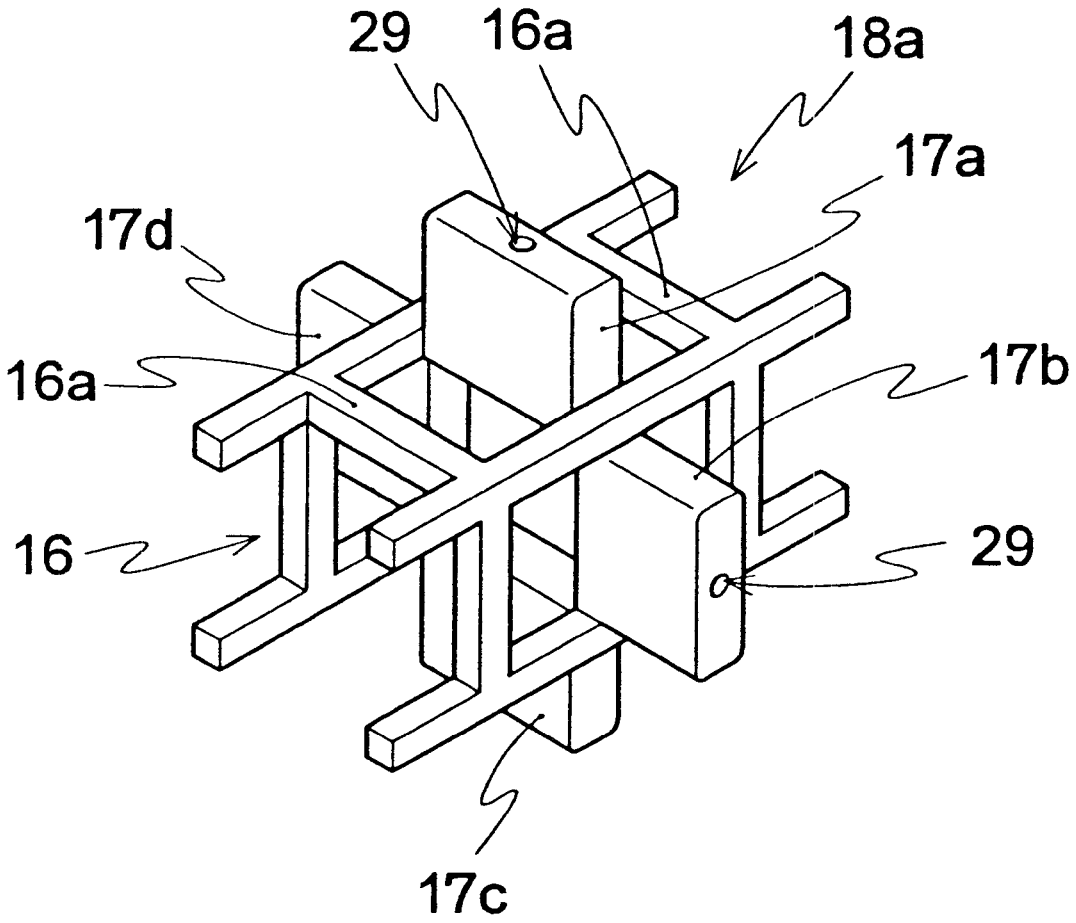
FIG. 3 is a perspective view showing another embodiment of the iron core positioning tool.

The electromagnetic portion 2 is assembled into a cross-shaped iron core positioning tool 18 with eight bridge portions 16*a* and four supporting portions 17*a*, 17*b*, 17*c*, 17*d* being formed at outer peripheral portions of an angular hole portion 16, while a frame portion 19 is formed at the outer surface thereof. The shape of the iron core positioning tool 18 is not limited to this, and it is also possible to omit bottom pieces between four corner portions of the angular hole portion 16 as illustrated in FIG. 3. By employing iron core positioning tool 18*a* with the bottom pieces being omitted, it is possible to eliminate effects of inconsistencies in thickness of the bottom pieces such that the accuracy of the clearance portion can be secured. A suitable material for the iron core positioning tool 18 might be heat-resistant resin or non-magnetic metal such as aluminum capable of resisting heat of approximately 150° at the time of molding.

A suitable material for the frame portion 19 is BMC (balk mold compound) which is a molding material exhibiting heat-resistance and low shrinkage rate, and it is possible to utilize, for instance, unsaturated polyester type BMC.

Each electromagnet 1 is composed of an iron core 20 having an E-shaped section and a winding coil portion 21 which is formed by winding a coil around a bobbin and which is installed into an outer peripheral concave portion of the E-shaped iron core 20, wherein the iron core 20 is composed of an outer yoke portion 22, side pole portions 23 disposed at both end portions of the outer yoke portion 22, and a π shaped center pole portion 24 disposed between the side pole portions 23. The outer yoke portion 22 and the side pole portions 23 are integrally formed by pressing a single steel plate such as a silicon steel plate, and extension portions 23*a*, which are bent at L-shaped angles in directions as to face towards each other by pressing a single steel plate, are formed at inner peripheral polar portions of the side pole portions 23. The center pole portion 24, which is mounted to the outer yoke portion 22, is composed of a pair of magnetic polar portions 25 which are remote from each other by a specified distance L such that a magnetic path formed by the polar portions of the center pole portion 24 will be an open circuit. It is preferable that the distance L is designed to be a smallest permissible one as long as it assumes a dimension with which screws 27 as will be described later can be inserted. Inner peripheral polar portions of the pair of magnetic polar portions 25 are formed with extension portions 25*a* which are bent at L-shaped angles in directions facing away from each other. Each of the extension portions 23*a*, 25*a* are disposed to respectively oppose the permanent magnets 3. It is possible to adjust the dimension of the clearance portion by these extension portions 23*a*, 25*a* while the dimension of the clearance can also be controlled by a thickness dimension of a bridge portion 16*a* of the iron coil positioning tool 18. Consequently, it is enabled to adjust reactance of the wiring coil and to further restrict current values to the wiring coil 21. It should be noted that while the iron core is so formed that bend parts are assembled through pressing a steel plate in the present embodiment, it is also possible in the present invention to form the iron core by laminating a plurality of stator cores of silicon steel plate which are preliminarily provided with the side pole portions and the center pole portion.

Assembly of the electromagnetic portion 2 according to the present embodiment is performed in the following manner as exemplarily illustrated in FIG. 2: the center pole portion 24 of the iron core 20 with the wiring coil portion 21 being installed therein is inserted into the supporting portion 17*a* of the iron positioning tool 18; side pole portions 23 are fitted into an outer peripheral groove 26 of the angular hole portion 16 while the bridge portion 16*a* is fitted between the side pole portions 23 and the center pole portion 24; and the screw 27 is thereafter screwed into screw hole 29 by passing through hole 28 to complete installation of one electromagnet 1. The other electromagnet 1 is similarly installed to the supporting portion 17*c* opposing the supporting portion 17*a*.

Thereafter, the center pole portion 24 of the iron core 20 is inserted into the supporting portion 17*b*; side pole portions 23 are fitted into the outer peripheral groove 26 of the angular hole portion 16 while the bridge portion 16*a* is fitted between the side pole portions 23 and the center pole portion 24; and the screw 27 is thereafter screwed into screw hole 29 by passing through the hole 28 to complete installation of one iron core 20. The other iron core 20 is similarly installed into a supporting portion 17*d* opposing the supporting portion 17*b*.

Figure 5A:
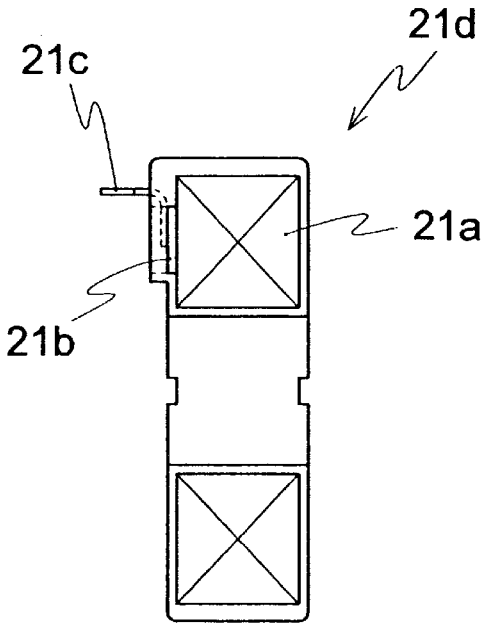
FIG. 5(*a*) and FIG. 5(*b*) are a sectional view and a plan view of a molded coil, respectively.
Figure 5B:
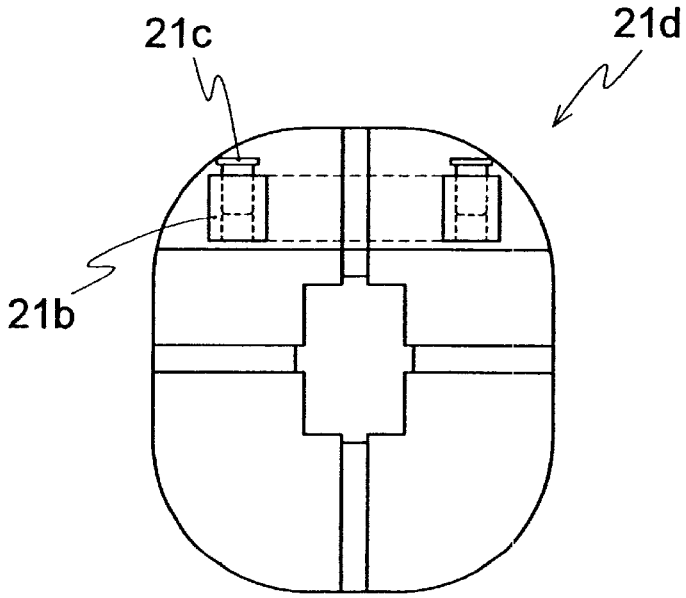

While the iron core 20 within the electromagnet 1 is installed with the wiring coil portion 21 formed by winding a coil around a bobbin in the above explanations, the present invention is not limited to this arrangement. It is alternatively possible to install a molded coil 21*d* to the iron core within the electromagnet with a lag plate 21*b* and a lag terminal 21*c* being preliminarily molded in an integral manner to only the coil 21*a* of the wiring as illustrated in FIG. 5. By using such a molded coil with only the coil of the wiring being molded, it is possible to prevent deformation owing to a pressure of molded resin at the time of forming mold resin portions to the electromagnets. It is particularly possible to eliminate the fear of cutting wires through deformation in the case of coil wires of small diameters.

Figure 6:
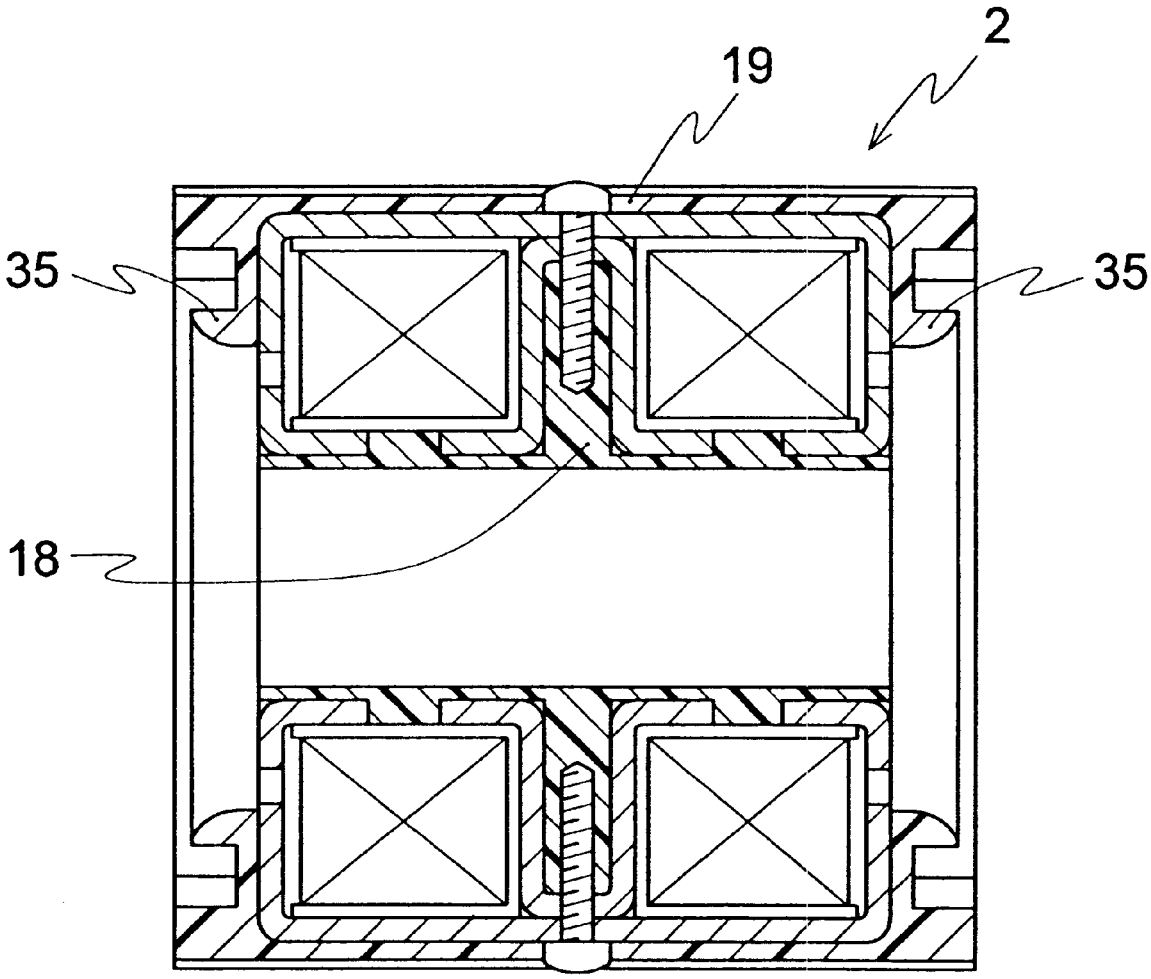
FIG. 6 is a longitudinal sectional view showing one embodiment of a frame portion molded to the electromagnetic portion.
Figure 7:
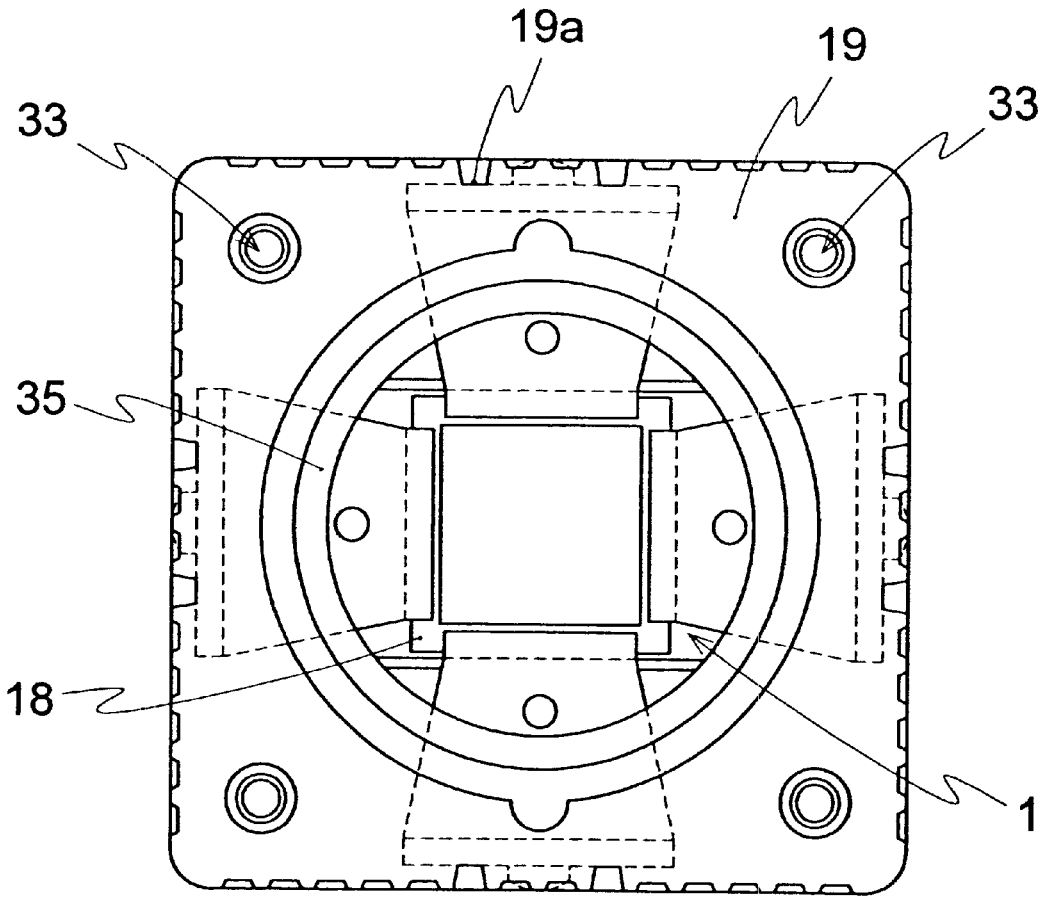
FIG. 7 is a side view showing one embodiment of a frame portion molded to the electromagnetic portion.
Figure 8:
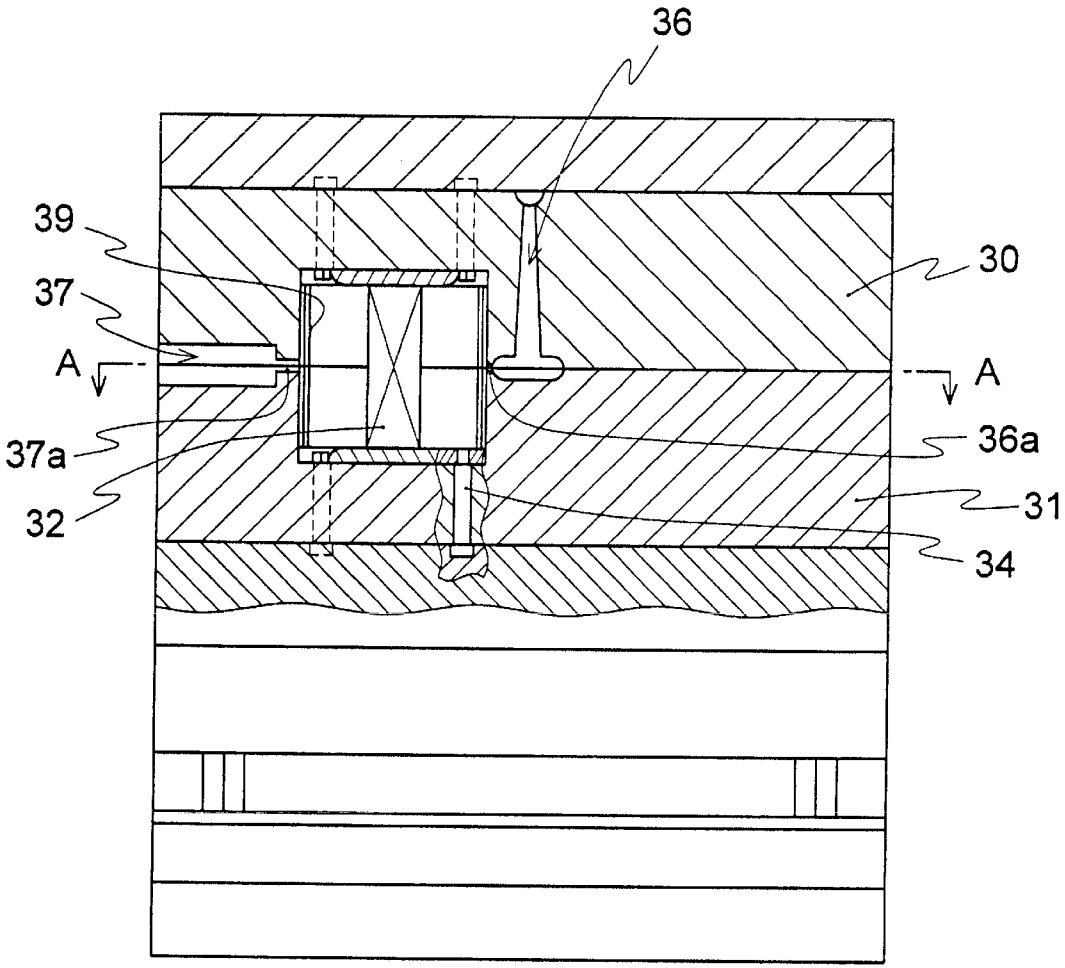
FIG. 8 is a partial sectional view showing one embodiment of dies employed in a manufacturing method of the present invention.
Figure 9:
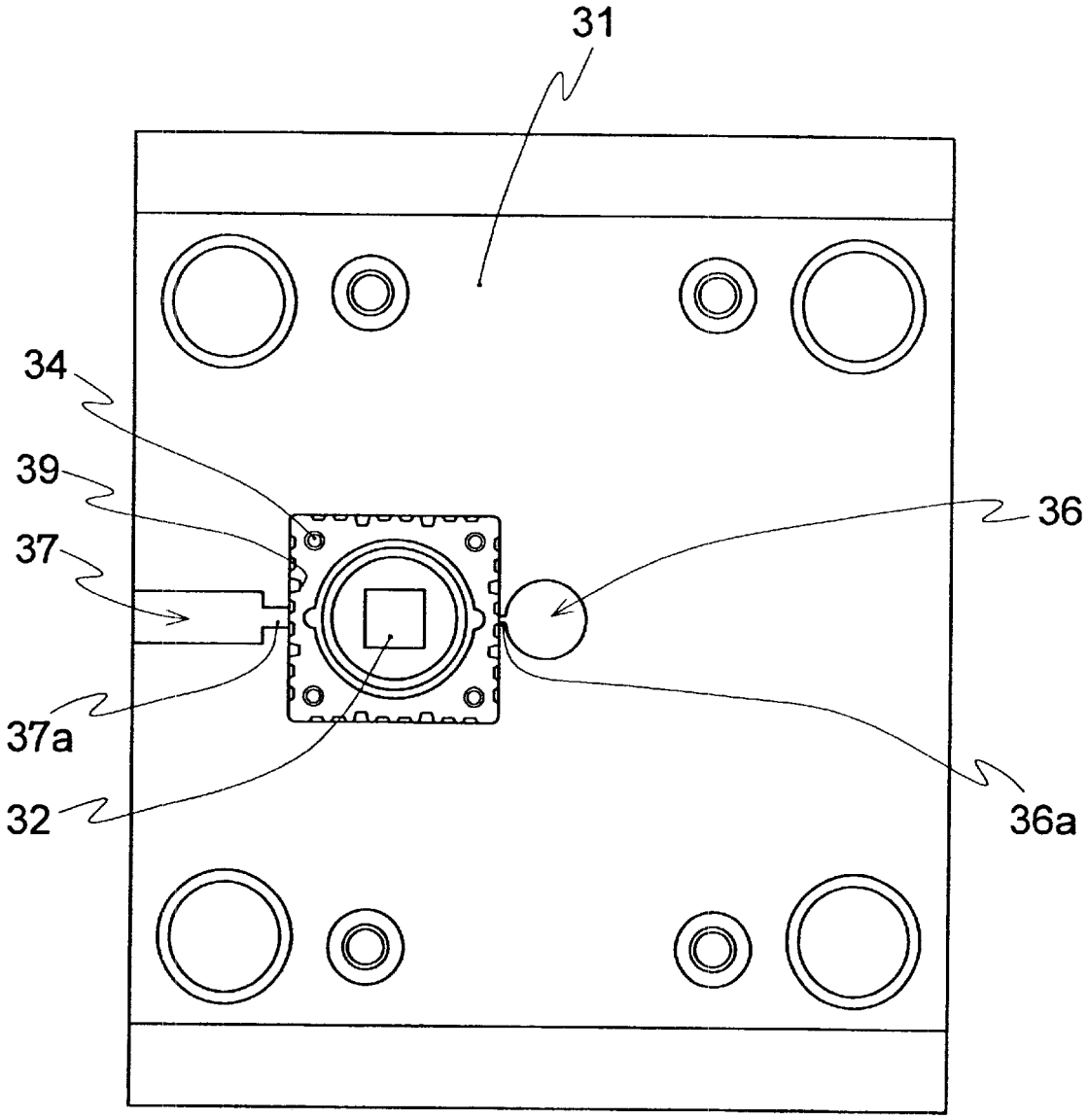
FIG. 9 is a sectional view taken along the line A—A of FIG. 8.

In the present embodiment, the electromagnetic portion 2 illustrated in FIG. 4 is disposed into molding dies for forming the frame portion 19. As exemplarily illustrated in FIGS. 8 and 9, such dies are composed of an upper die 30 on a moving side and a lower die 31 on a fixed side, wherein the dies are so arranged that an angular core 32 to be inserted into the iron core positioning tool 18 and supporting pins 34 for receiving insert nuts 33 provided at screw holes on four corners (see FIG. 7) are disposed in a concave portion formed on opposing surfaces between the upper die 30 and the lower die 31, and that contours of the mounting portions 35 for the diaphragms 5 are formed. An injection inlet 36*a* and a discharge outlet 37*a* communicating to an injecting potion 36 and a discharge portion 37 for the resin, respectively, are formed in the upper die 30 and the lower die 31 to be open to the concave portion. In using the dies, the electromagnetic portion is positioned into the molding dies at the time of molding, resin is injected into the cavity through the injection portion 36, and the iron core 20 is fixed by means of pins of the dies (not shown) by utilizing holes 38 formed at the side pole portions 23 of the outer yoke portion 22 of the iron core 20 to mold resin on the outer surface while leaving a portion in the periphery of the angular hole portion 16. In this manner, it is possible to integrally form the frame portion 19 to the electromagnetic portion 2 with the iron core positioning tool 18 being installed therein as illustrated in FIGS. 6 and 7. For preventing the iron core 20 from being lifted or inclined owing to resin pressure at the time of molding, it is preferable to form protrusions 39 corresponding to reference numerals 19*a* at the inner walls of the concave portion of the die as to contact the outside of the iron core 20.

Upon completion of molding of the electromagnetic portion 2, the oscillator 4 and the diaphragms 5 are installed, the pump casings 6 are disposed on both ends, and the lateral side lids 7 are assembled by means of assembling screws 40 as shown in FIG. 1.

Since the frame portion 19 is integrally formed to the outer surface of the electromagnetic portion 2, the iron cores 20 and the coil constituting the electromagnetic portion 2 are firmly coupled to eliminate rattles and thus to improve the rigidity thereof. This improvement in rigidity further contributes to restrict oscillation and further to reduce noise generated at the pump portions. The frame portion 19 of the electromagnetic portion 2 further eliminates the necessity of yokes of electromagnetic materials conventionally disposed at the outer periphery of the electromagnetic portion, and it is possible to prevent generation of a leakage circuit in the magnetic circuit and thus to improve oscillating characteristics.

In case the iron cores are separately inserted into the dies without using the iron core positioning tool, the structure of the dies for holding the iron cores will become complicated and it is required to perform a large number of process steps for mounting. In contrast, since the electromagnetic portion 2 is inserted into the molding dies with the iron cores 20 being assembled to the iron core positioning tool 18 in the present invention, the positioning of the iron cores can be reliably performed to improve productivity while also decreasing manufacturing costs since such an arrangement of the dies is simple and of low cost. It is further enabled by the iron core positioning tool 18 to improve the dimensional accuracy of the clearance portion formed between the permanent magnets 3 and the iron cores 20 as well as the positional accuracy of the four iron cores in the axial direction.

Since the mounting portion 35 for mounting the diaphragms 5 has been integrally formed with the frame portion 19 simultaneously with forming the frame portion 19, it is possible to eliminate one part of the diaphragm base as well as one process for the assembly, and thus, to decrease manufacturing raw costs. The assembling characteristics are further improved since it is only required to mount the pump casings 6 and the lateral side lids 7 to the electromagnetic portion 2 to which the frame portion 19 has been integrally formed.

Figure 10:
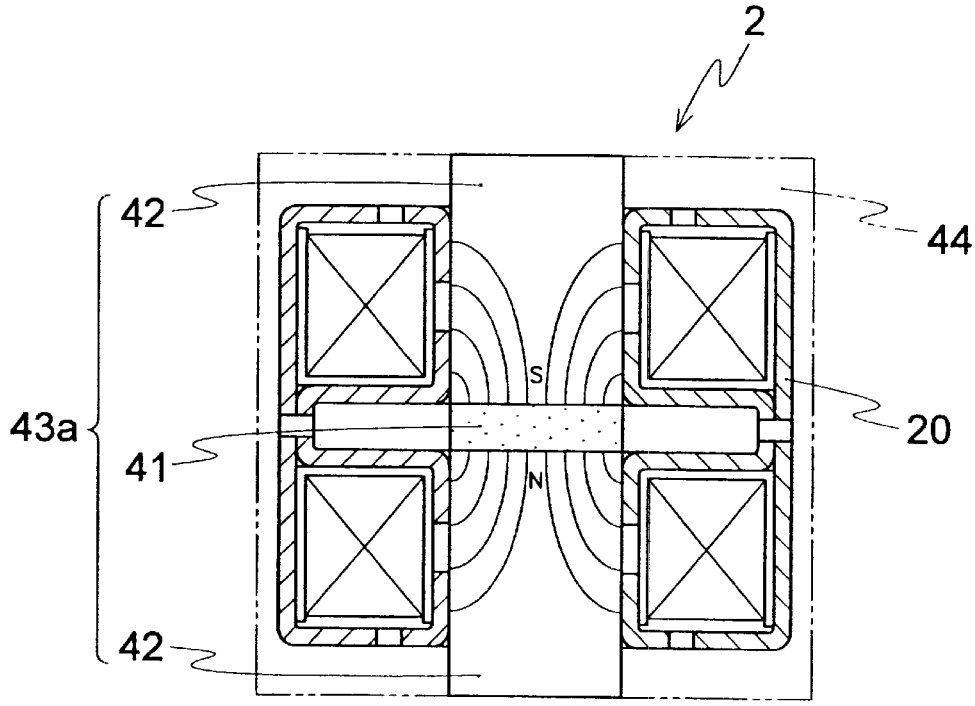
FIG. 10 is an explanatory view showing a manufacturing method in which the iron core positioning tool has been omitted.

According to the present embodiment, the frame portion is integrally formed with an electromagnetic portion of four-pole two-coil type which is installed to the iron core positioning tool. It is alternatively possible in the present invention to integrally form the frame portion with an electromagnetic portion composed of one ring-like iron core, or an electromagnetic portion composed of one or a plurality of iron cores of two-pole two-coil type or of four-pole four-coil type as shown in FIG. 10. It is further possible to integrally form the frame portion to the electromagnetic portion with the iron core positioning tool being eliminated.

Figure 11:
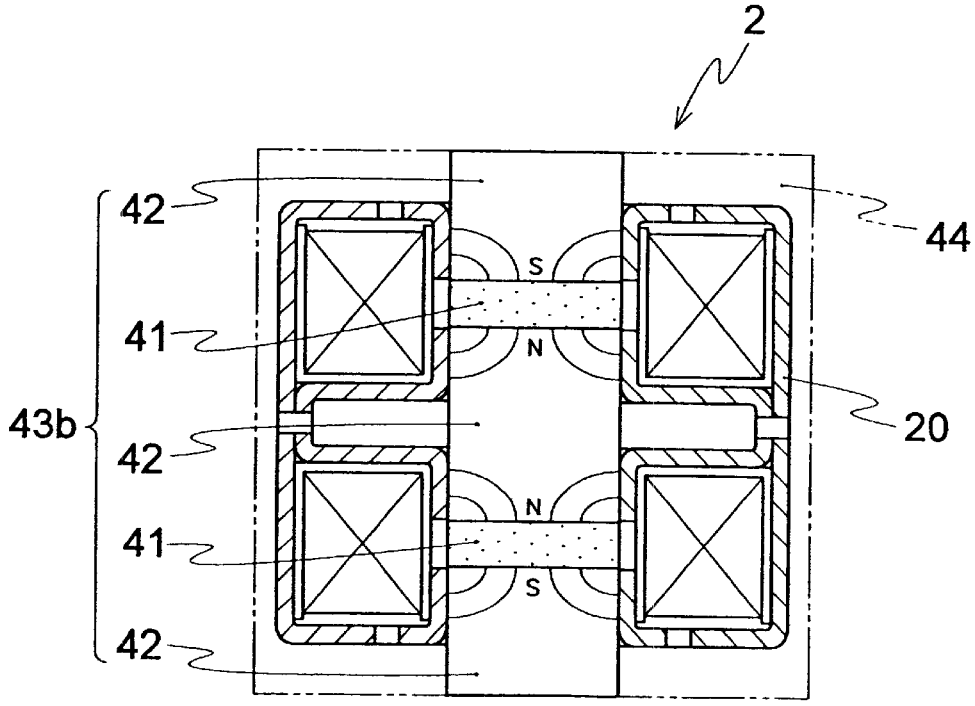
FIG. 11 is an explanatory view showing another manufacturing method in which the iron core positioning tool has been omitted.

A method for integrally forming the frame portion to the electromagnetic portion with the iron core positioning tool being eliminated will now be explained. In this embodiment, as shown in FIGS. 10 and 11, the electromagnetic portion 2 is so arranged that iron cores 20 constituting the electromagnetic portion 2 are placed in a proximity to an iron core positioning tool 43*a* obtained by adhering two soft magnetic bodies 42 with one magnet 41 being pinched therebetween or to an iron core positioning tool 43*b* obtained by adhering three soft magnetic bodies 42 with two magnets 41 being pinched therebetween. In this manner, the iron cores 20 with the attached coil are absorbed by a magnetic field formed by the magnet 41 as shown in FIGS. 10 and 11 to perform positioning of iron coils 20. Thereafter, the electromagnetic portion 2 is disposed in dies with a concave portion being formed by upper and lower dies. Resin is injected into the cavity of the dies for molding resin to an outer periphery of the electromagnetic portion 2 to thereby form a frame portion 44 through resin molding. Upon completion of molding, the iron core positioning tools 43*a*, 43*b* are detached. These iron core positioning tools 43*a*, 43*b* are continuously used for the following process of molding.

Figure 12:
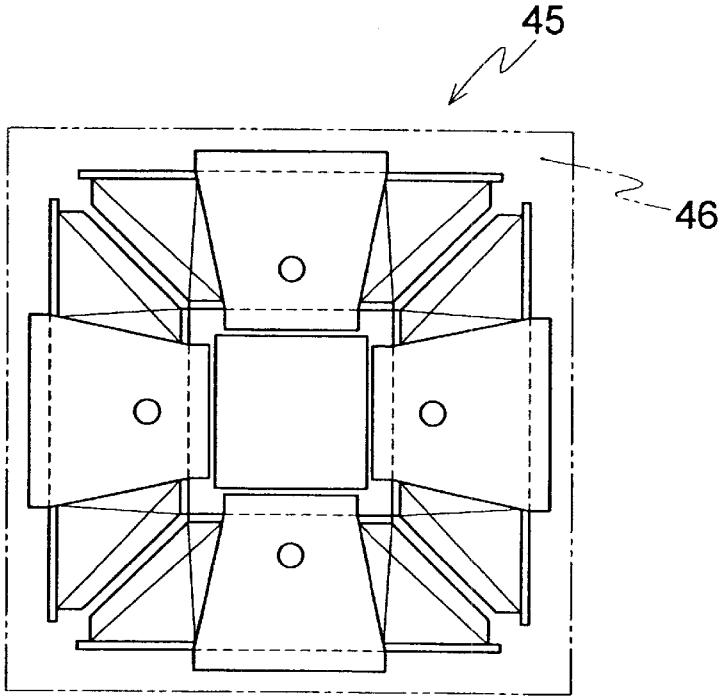
FIG. 12 is a sectional view of an electromagnetic portion of four-polar four-coil type.
Figure 13:
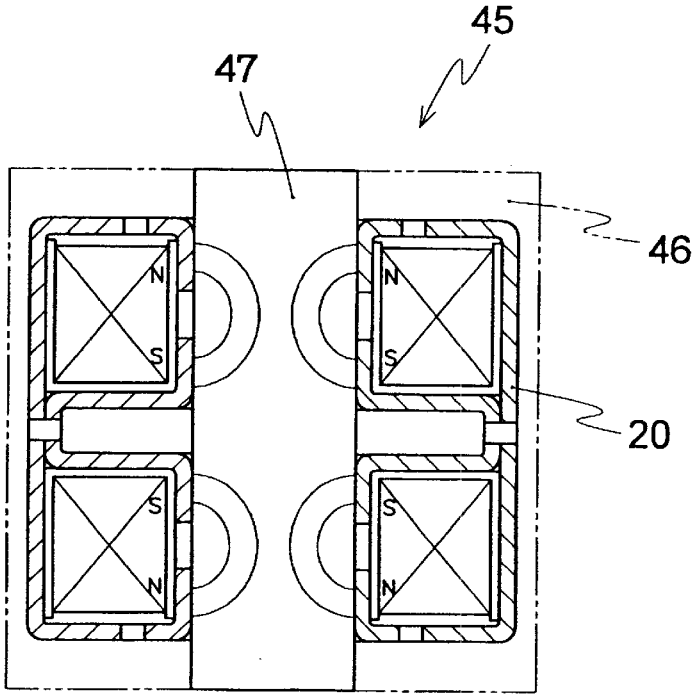
FIG. 13 is an explanatory view showing still another manufacturing method in which the iron core positioning tool has been omitted.

Another method for integrally forming a frame portion to the electromagnetic portion with the iron core positioning tool being eliminated will now be explained based on a case in which a frame portion 46 is integrally formed to a four-pole four-coil type electromagnetic portion 45 as shown in FIG. 12. First, the iron cores 20 constituting the electromagnetic portion 45 are disposed into dies with an angular core for insertion 47 being formed in a central portion of a concave portion formed by the upper and lower dies as shown in FIG. 13. The electromagnetic portion 45 is applied with power thereafter. In this manner, the iron cores 20 can be positioned and fixed to the angular core for insertion 47 through a magnetic attraction between the angular core for insertion 47 and the iron cores 20. Upon injection of resin into the cavity of the dies and molding resin to an outer surface of the electromagnetic portion 45, the frame portion 46 is formed through resin molding. It should be noted that it is possible to employ the iron core positioning tool shown in FIG. 3 also in the methods shown in FIGS. 10, 11, 12 and 13. It is particularly easy to perform placement to the dies by using the iron core positioning tool of FIG. 3 especially in the cases of FIGS. 12 and 13.

Figure 14:
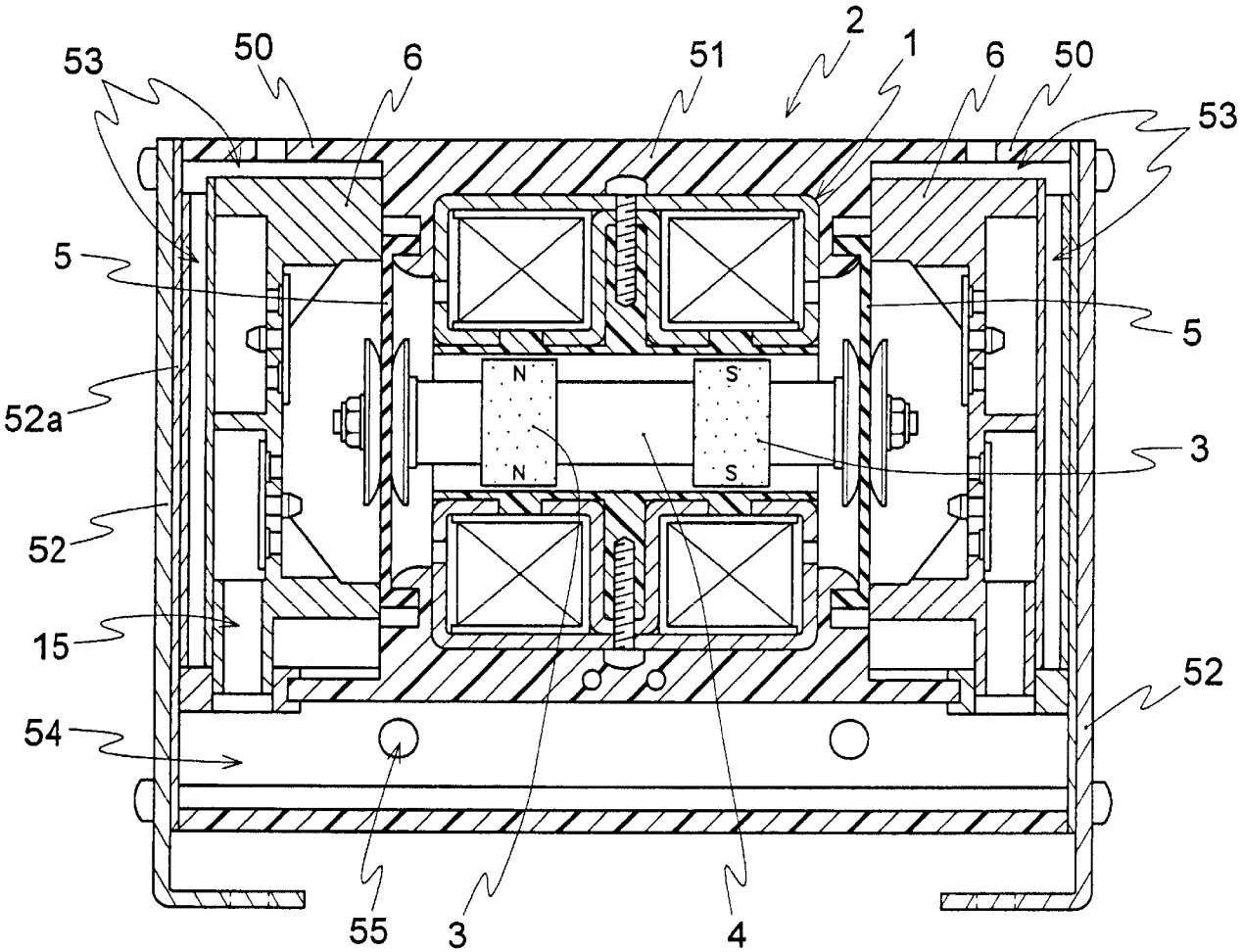
FIG. 14 is a longitudinal sectional view showing another embodiment of an electromagnetic oscillating type pump according to the present invention.
Figure 15:
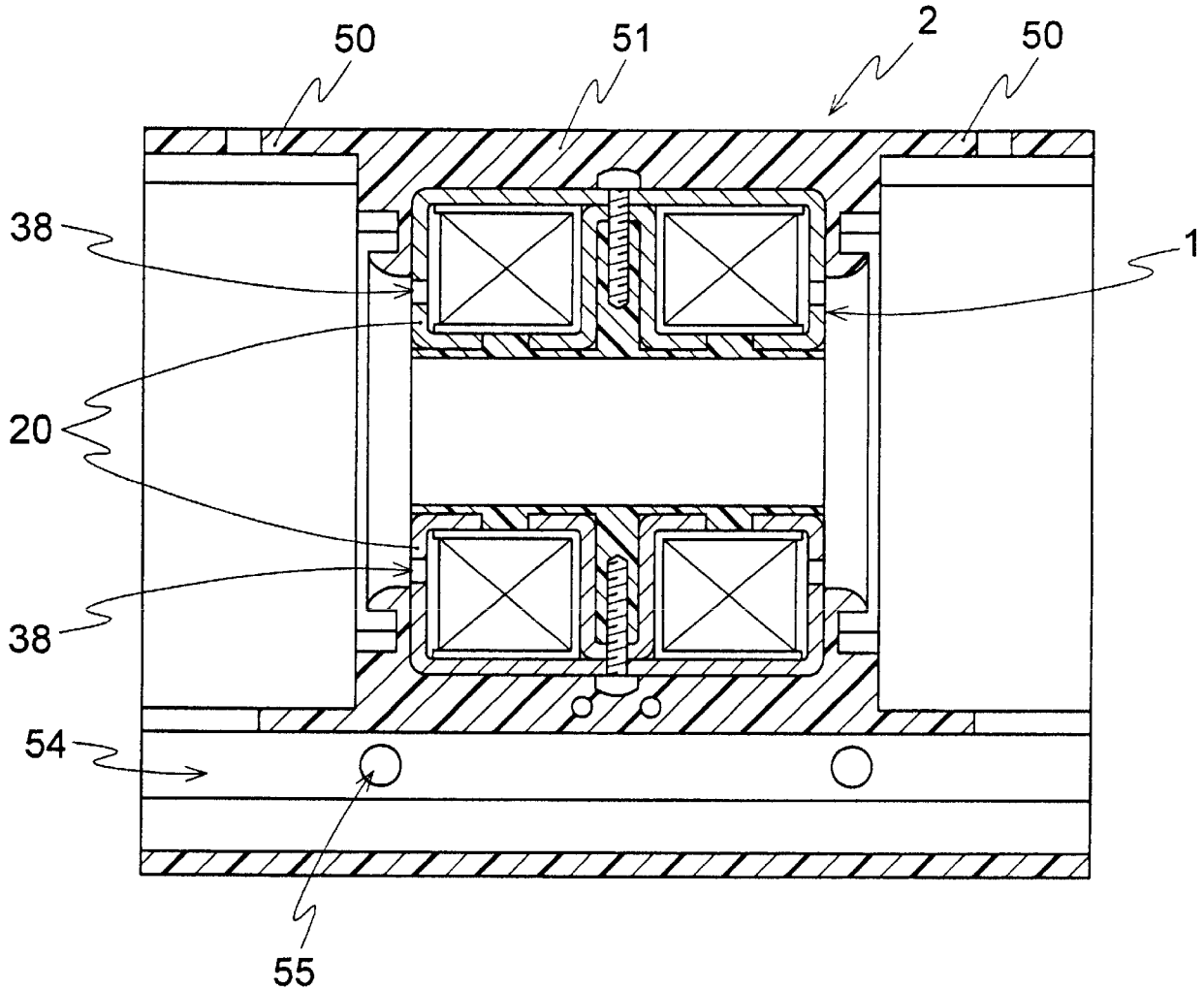
FIG. 15 is a longitudinal sectional view showing a frame portion molded to the electromagnetic portion in FIG. 14.
Figure 16:
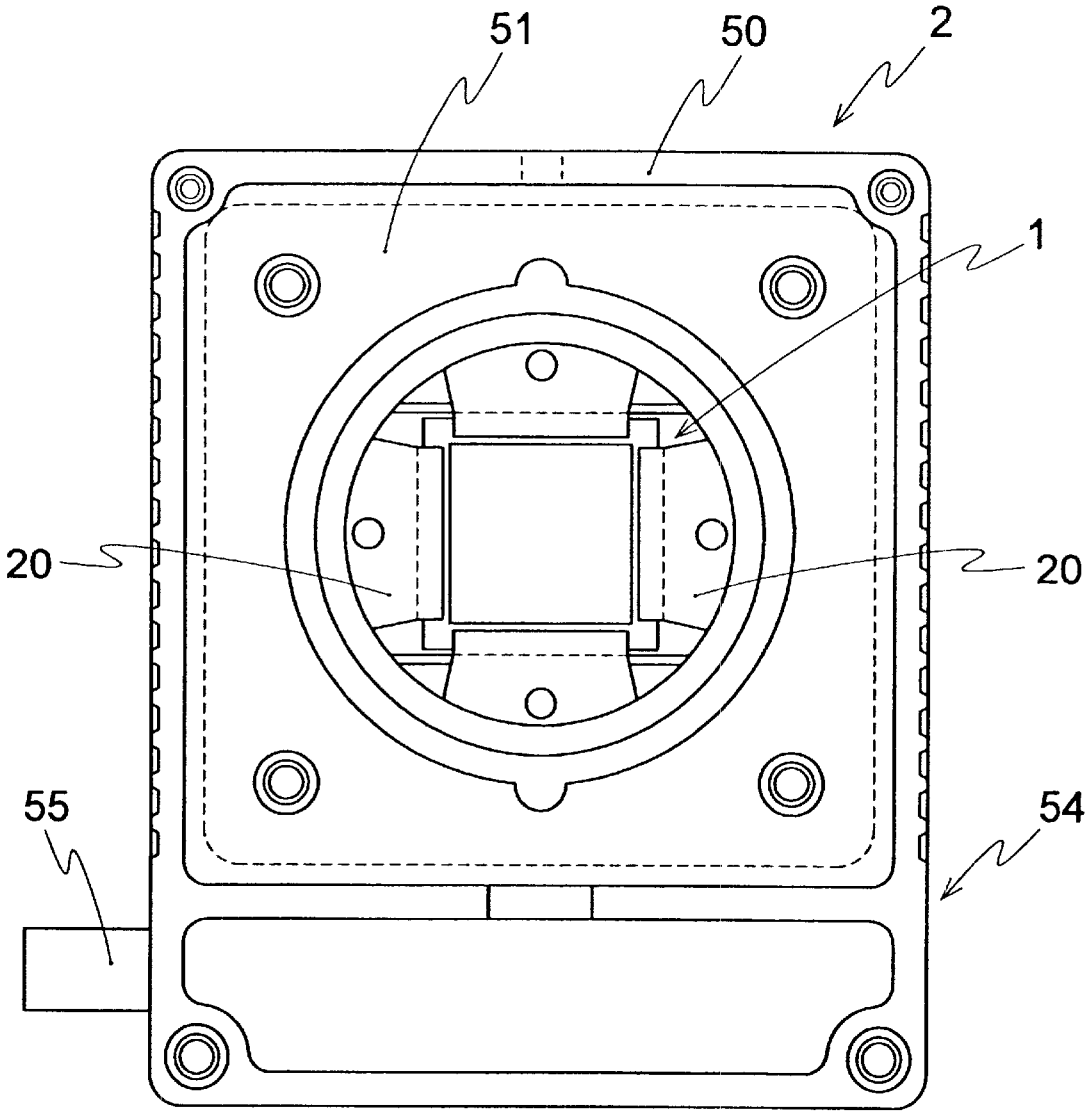
FIG. 16 is a side view showing the frame portion molded to the electromagnetic portion in FIG. 14.

Another embodiment of the electromagnetic oscillating type pump will now be explained. As shown in FIGS. 14 to 16, the electromagnetic oscillating type pump is composed of an electromagnetic portion 2 comprising of a pair of electromagnets 1 and a pair of iron cores 20 which are disposed as to oppose each other, an oscillator 4 having permanent magnets 3, diaphragms 5 connected to both ends of the oscillator 4, and pump casings 6 which are respectively fixed to both end sides of the electromagnetic portion 2. An acoustic insulating wall 50 provided at an outer peripheral portion of the pump casings 6 fixed to both lateral surfaces of the electromagnetic portion 2 are integrally formed with the frame portion 19 to provide the frame portion 51. The pump casings 6 are housed within the acoustic insulating wall 50 and lateral side lids (valve chamber lids) 52 are fixedly attached to lateral surface sides of the pump portions of the pump casings 6 with packings 52*a* being pinched therebetween. The lateral side lids 52 are manufactured of metallic material and exhibit high acoustic insulating characteristics (sound isolating characteristics). Mounting legs 52 are integrally formed with the lateral side lids 52*b* to make mounting to the mounting portion easy.

In case the pump casings 6 are housed within the acoustic insulating wall 50, it is preferable that clearances 53 is formed inside of the acoustic insulating wall 50 for the pump casings 6 and inside of the lateral side lids 52 fixedly attached to end surfaces of the acoustic insulating wall 50. While a double structure composed of, for instance, a separate acoustic insulating housing is required in case the acoustic insulating wall 50 is not molded, oscillation from the pump portions can be eased due to air in the clearances 53 through the double structure of the pump casings 6 and the acoustic insulating wall 50 forming these clearances 53, and it is thus possible to obtain a small-sized pump with improved acoustic insulating characteristics.

It should be noted that in forming the frame portion 51 to the electromagnetic portion 2, it is preferable to perform fixing of the iron cores 20 by means of pins of the dies utilizing holes 38 formed in the iron cores 20 for molding resin thereafter. It is also preferable to simultaneously form at least one air tank 54 exhibiting functions of a silencer to a lower portion of the frame portion 51 in an integral manner. By arranging such an air tank 54, it is possible to once store air which has been discharged from the discharge nozzle portion 15 and to exhaust the same through exhaust port 55 to thereby decrease exhaust sounds. Disposing an filter of felt or polyester fiber into the air tank 54 will eliminate impurities such as dust when air passes through the filter, and it is thus enabled to exhaust purified air. Further, in case of forming a plurality of air tanks, it is possible to use one of them as a filter inserting portion for the suction port or to use other tanks as portions for accommodating parts such as relays or switches.

It is also possible in the present invention to integrally form the air tank with silencer functions simultaneously at the time of forming the frame portion 19 to the electromagnetic portion 2 of the illustrated embodiment.

Figure 17:
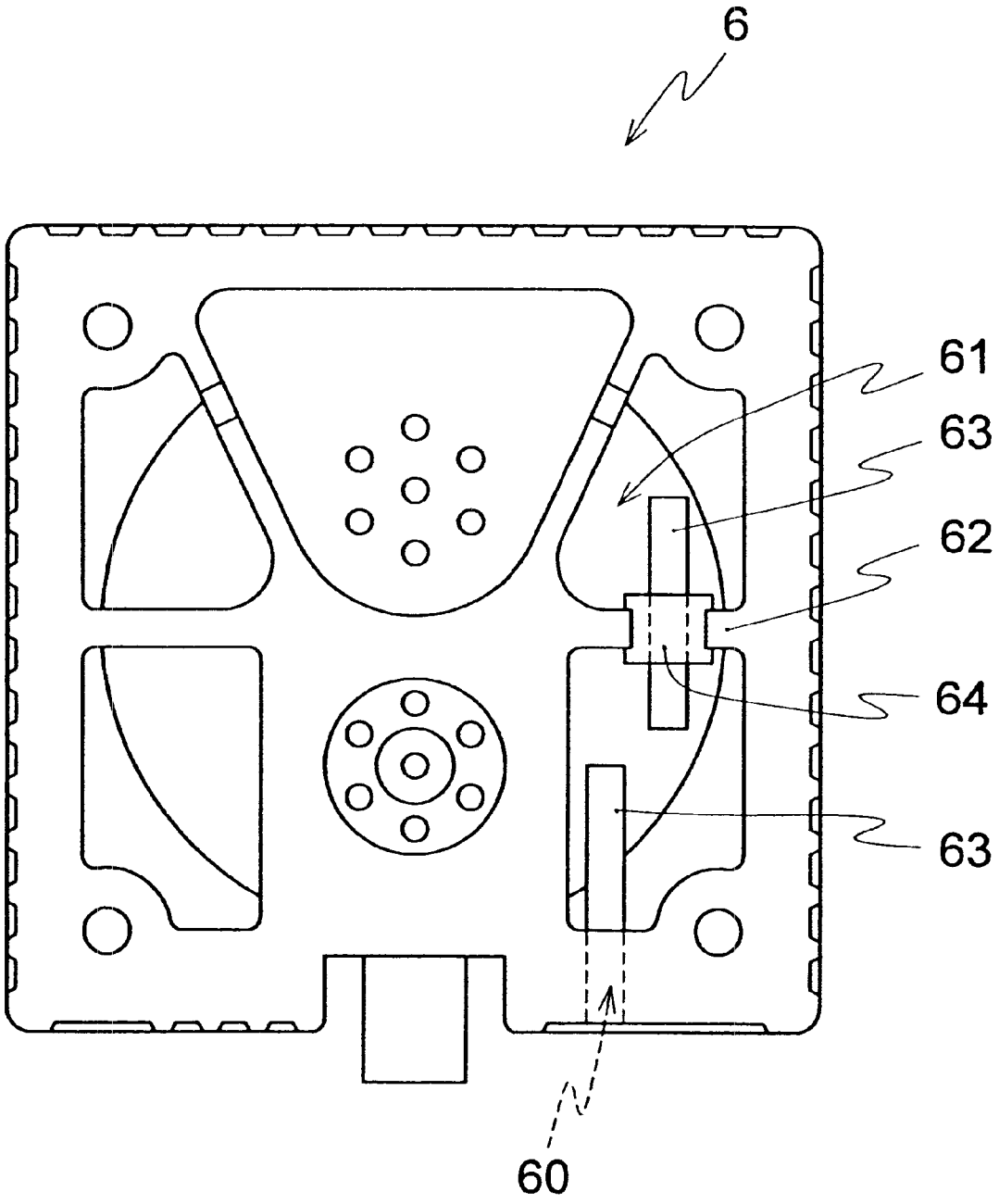
FIG. 17 is a sectional view taken along the line B—B of FIG. 1.

It is further possible to incorporate a tail pipe for silencer 63 for decreasing induction sounds within pump portions fixed to both lateral surfaces of the electromagnetic portion, that is, to an air intake port 60 within pump casings 6 and/or a partition 62 in a cavity section 61 communicating with a suction chamber as shown in FIG. 17. For attaching the tail pipe for silencer 63 to the partition 62, it is preferable that the partition 62 is partially notched and that a tail pipe protecting bush 64 is preliminarily inserted into the notched portion to be fixed thereat.

Figure 18:
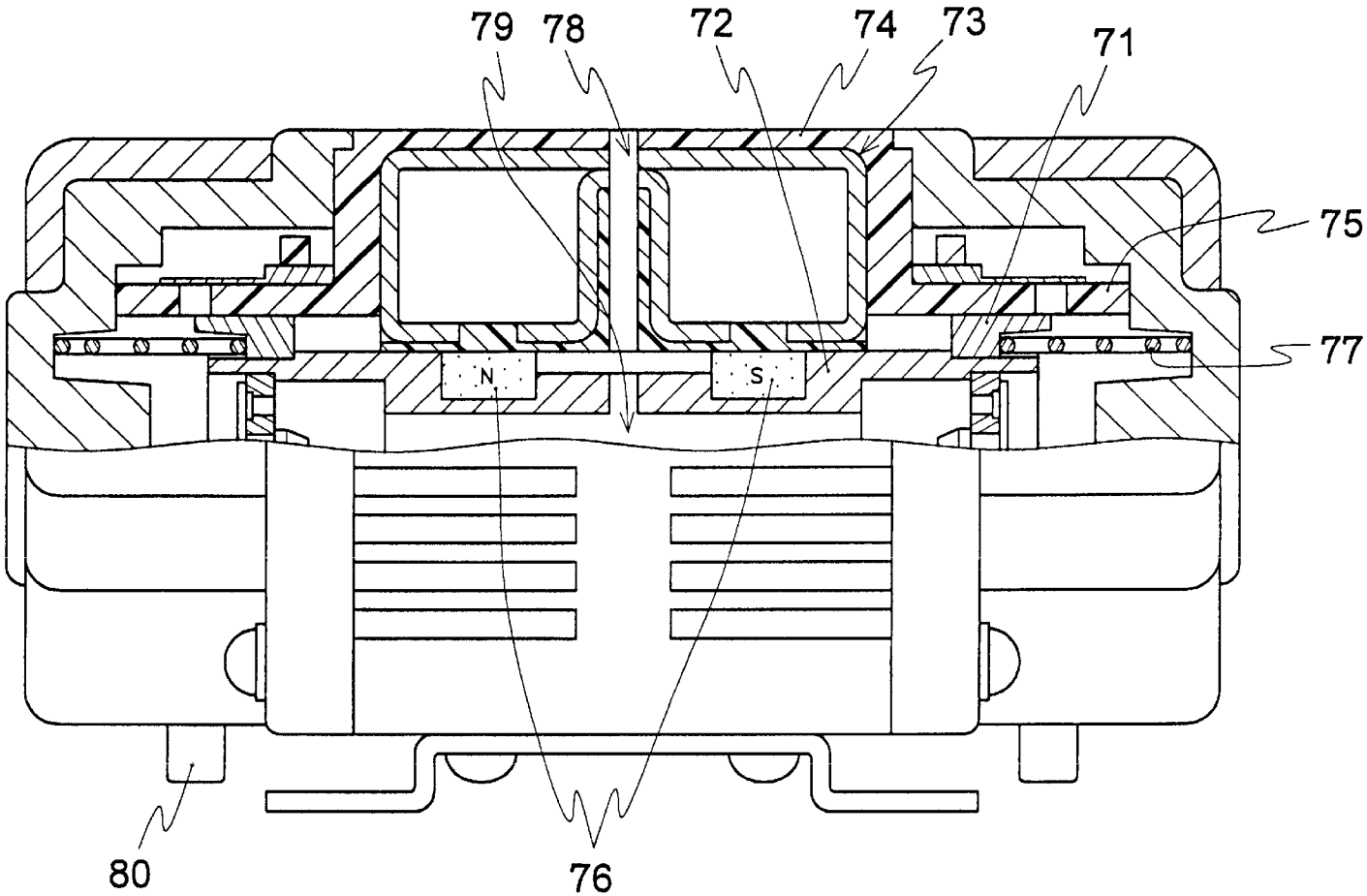
FIG. 18 is a longitudinal sectional view showing still another embodiment of an electromagnetic oscillating type pump according to the present invention.
Figure 19:
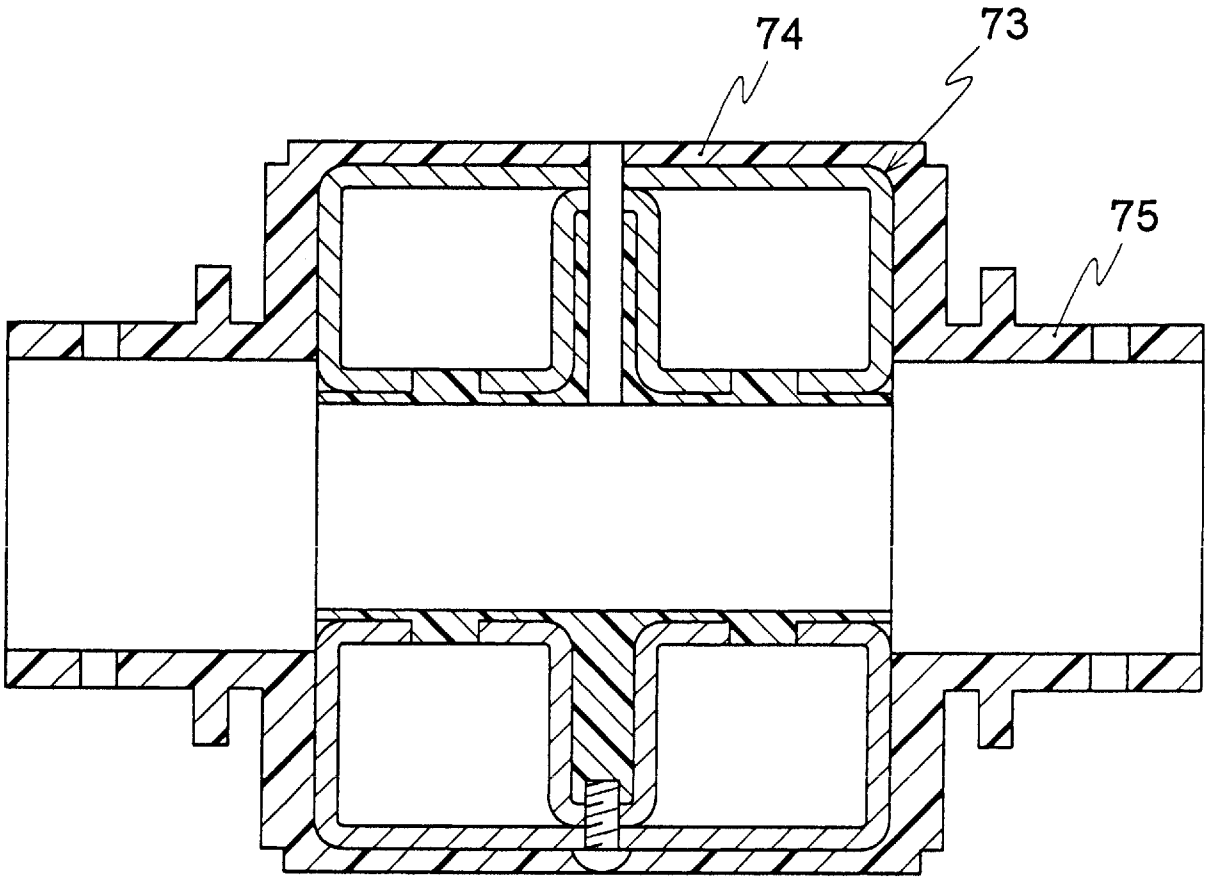
FIG. 19 is a longitudinal sectional view showing a frame portion molded to the electromagnetic portion in FIG. 18.
Figure 20:
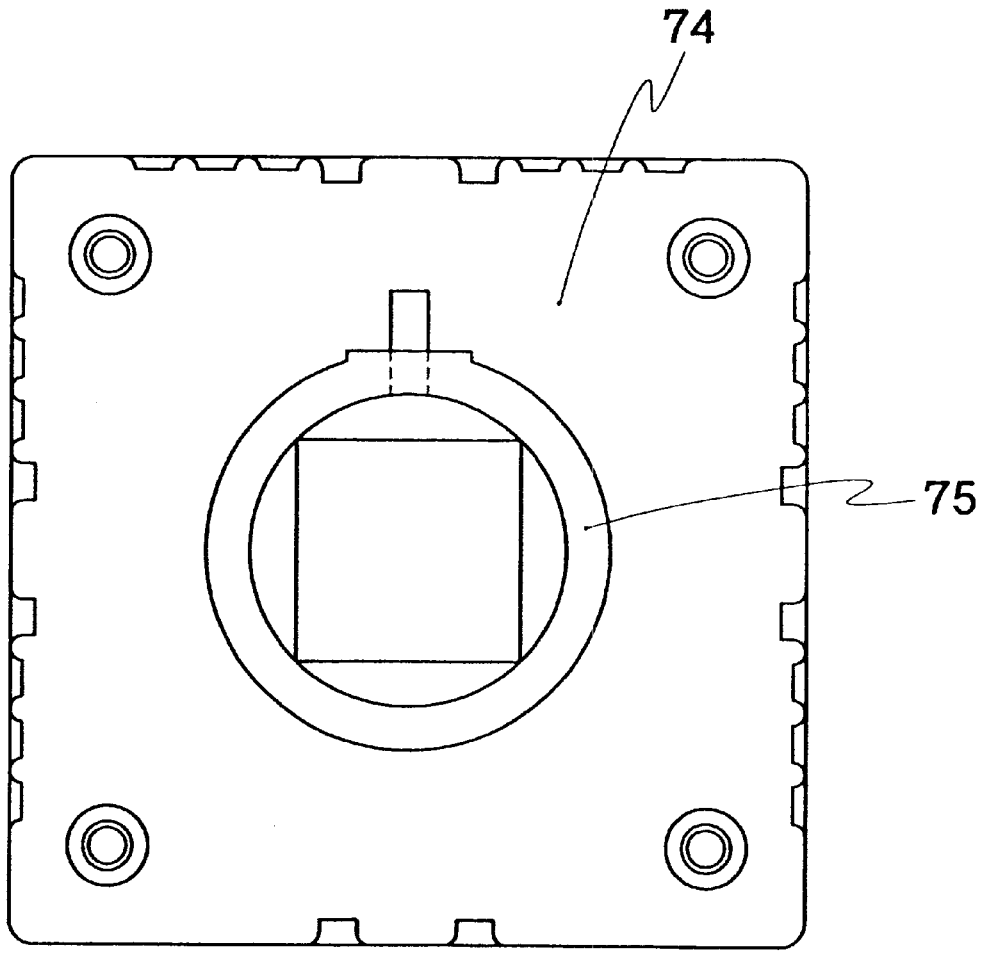
FIG. 20 is a side view showing the frame portion molded to the electromagnetic portion in FIG. 18.

Still another embodiment of the electromagnetic oscillating type pump will now be explained. As shown in FIGS. 18 to 20, the electromagnetic oscillating pump of the present embodiment is so arranged that the oscillator to which the diaphragms of the above-described diaphragm-type electromagnetic oscillating type pump are connected is replaced by a piston type electromagnetic oscillating type pump employing an oscillator 72 being formed with a piston 71. This piston type electromagnetic oscillating type pump is so arranged that a cylinder portion 75 is integrally formed with a frame portion 74 when forming the frame portion 74 to the electromagnetic potion 73. A pair of permanent magnets 76 are disposed at the oscillator 72 for moving the oscillator 72 in lateral directions owing to suction force of the electromagnetic portion 73 and the restoring force of a spring 77, and upon suction through suction ports 78, 79 formed at the electromagnetic portion 73 and the oscillator 72, fluid is discharged through discharge port 80.

While the oscillator 72 is formed as a non-active type pump moving in a same direction, the present invention is not limited to this type, and it is also possible to employ a pair of oscillators to make up an active type pump for performing suction and repulsion in an repetitive manner.

It should be noted that while it has been explained for an electromagnetic type pump with a magnetic oscillator, it is also possible to apply the present invention to an electromagnetic pump without using magnets but using only an oscillator of soft magnetic body such as iron or an iron alloy. Such an electromagnetic pump might be arranged to perform repetitive movements of the oscillator by utilizing suction force of electromagnets and restoring force of a spring.

Figure 21:
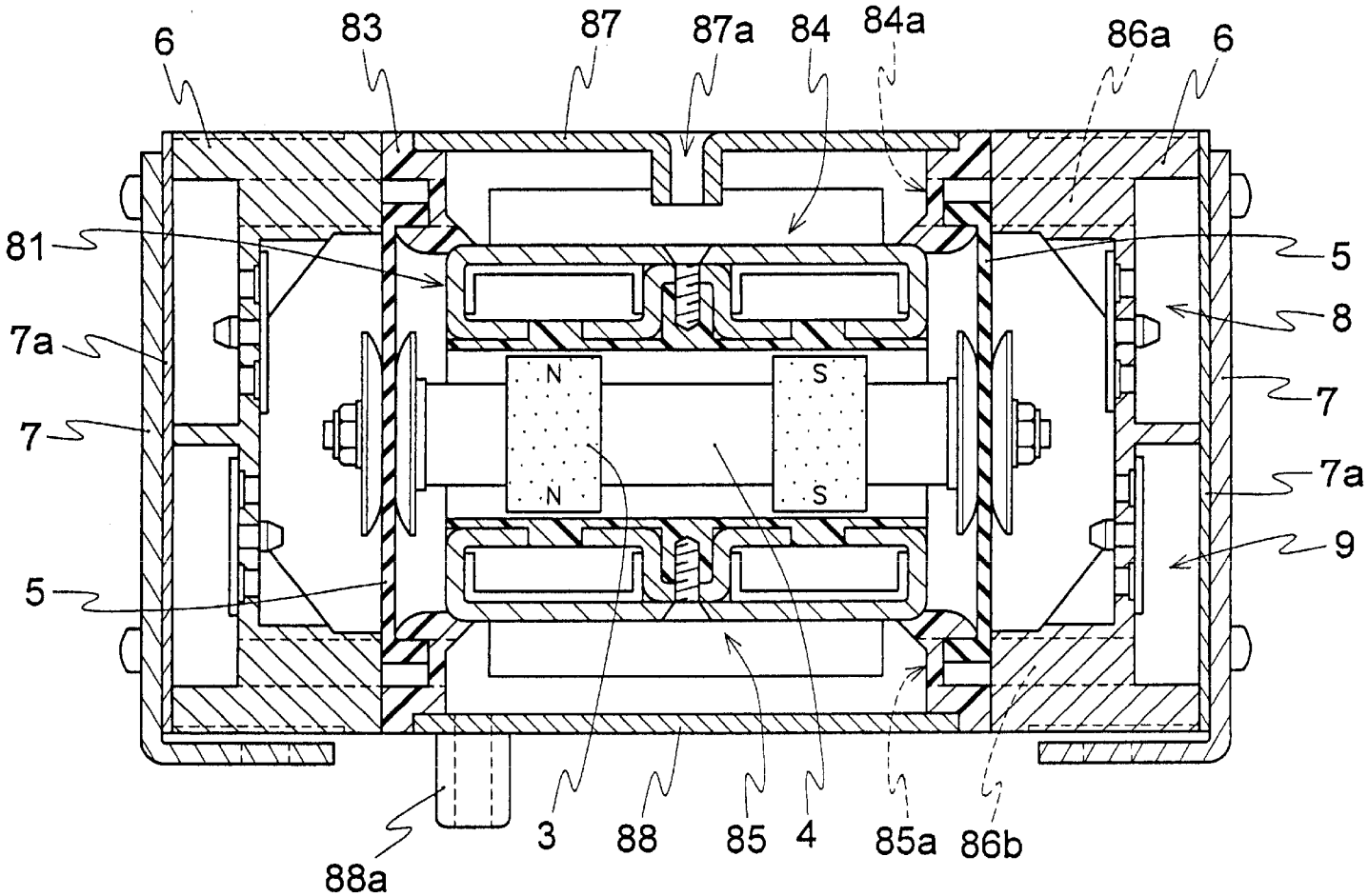
FIG. 21 is a longitudinal sectional view showing a further embodiment of an electromagnetic oscillating type pump according to the present invention.
Figure 22:
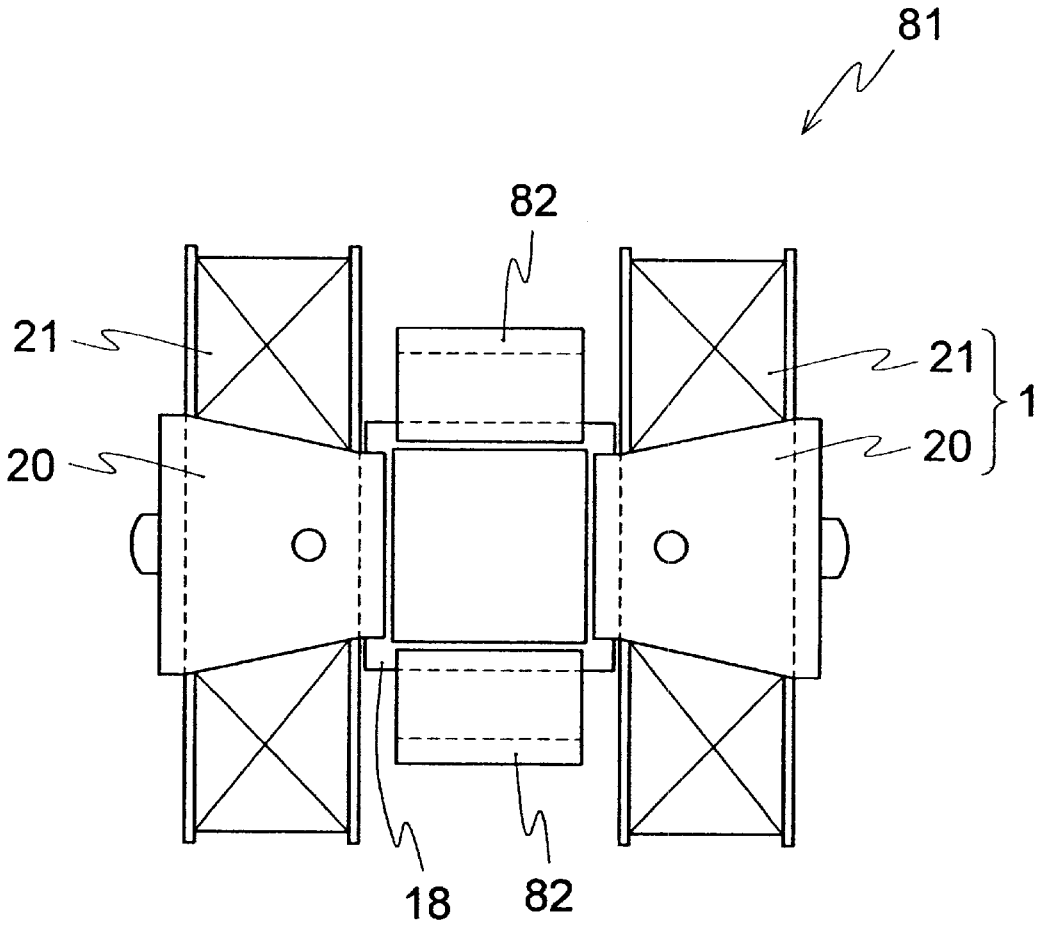
FIG. 22 is a perspective view showing a frame portion molded to the electromagnetic portion in FIG. 21.
Figure 23:
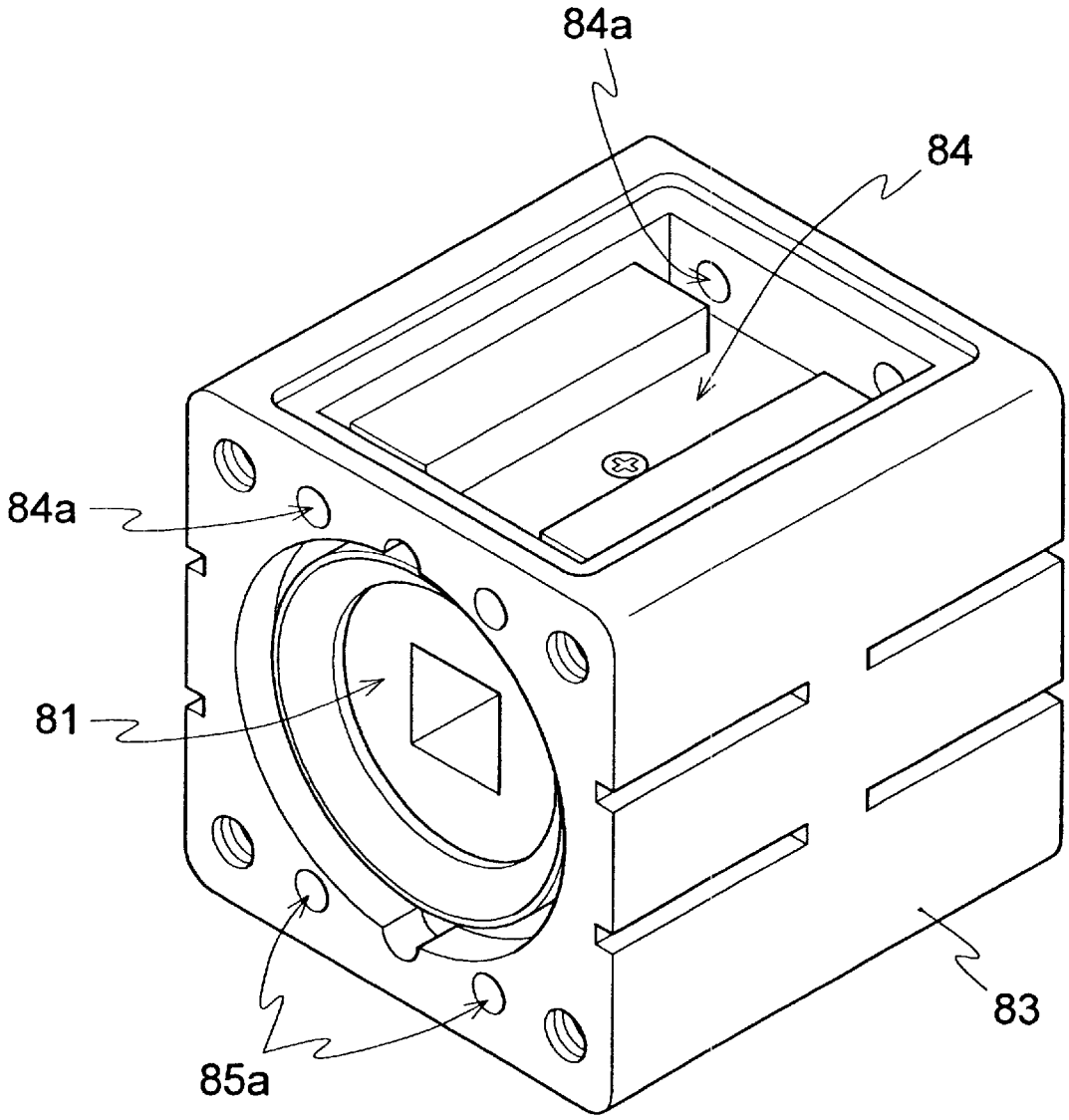
FIG. 23 is a side view showing the electromagnetic portion in FIG. 21.

Next, the following description will discuss still another embodiment of the electromagnetic oscillating type pump. As shown in FIGS. 21 to 23, an electromagnetic oscillating type pump according to the present embodiment is composed of: an electromagnet portion 81 which is different from that of the electromagnetic oscillating type pump of FIG. 1, an oscillator 4 having permanent magnets 3, diaphragms 5 connected to both ends of the oscillator 4, and pump casings 6 which are respectively fixed to both ends of the electromagnet portion 81, wherein lateral surface lids (valve chamber lids) 7 are fixed to a side of the pump casing 6 with packings 7*a* being pinched therebetween.

The electromagnet portion 81 is composed of an electromagnet 1 comprising a pair of large-diameter iron cores 20 and coil portions 21 which are placed to oppose each other, a pair of small-diameter iron cores 82, and a cross-shaped core positioning tool 18 which is assembled into the large-diameter iron cores 20 and the small-diameter iron core 82, and a molded frame portion 83 covering the outer surface thereof. The shape of the iron core positioning tool 18 is not necessarily limited to this shape, and as shown in FIG. 3, bottom portions between the four corner portions of an angular hole portion 16 might be omitted.

In the above-mentioned frame portion 83, concave sections 84 and 85 having a silencer function are formed in the peripheral portion of the pair of small-diameter cores 82. In the concave section 84, a path 84*a*, which communicates with a path 86*a* having an opening in a suction chamber 8 within the pump casing 6, is formed, and in the concave section 85, a path 84*b*, which communicates with a path 86*b* having an opening in a discharge chamber 9 within the pump casing 6, is formed. Moreover, a lid 87 having a suction section 87*a* is fixed to the concave section 84, while a lid 88 having a discharge section 88*a* is fixed to the concave section 85. With respect to the fixing method for the lids 87 and 88, fastening with screws, bonding or welding might be used, and among these methods, fastening with screws is preferably used because of its easiness in maintenance. Moreover, a filter made of felt or polyester fibers might be placed in the concave sections 84 and 85 so that, when air is allowed to pass through the filter, dusts or other impurities are removed therefrom to thereby discharge clean air.

In the present embodiment, air which has been sucked through the suction section 87*a* is once stored in the concave section 84, and then further sucked into the suction chamber 8 through the paths 84*a* and 86*a*; thus, it is possible to reduce suction noise. Moreover, air which has been discharged into the discharge chamber 9 is sucked into the concave section 85 through the paths 86*b* and 84*b*, and after having been temporarily stored in the concave section 85, it is discharged through the discharge portion 88*a*; thus, it is possible to reduce discharge noise. As compared with the aforementioned pump having a silencer function, in the pump according to the present embodiment, the concave section having a silencer function is formed within the outer-diameter dimension of the large-diameter iron core in the electromagnet portion; therefore, it is possible to miniaturize the pump.

Moreover, in the present embodiment, the concave sections 84 and 85 are formed in the peripheral portion of the pair of small-diameter iron cores 82; however, the concave section might be formed in the peripheral portion of at least one of the pair of small-diameter iron cores 82, and even in this case, it is possible to reduce suction noise or discharge noise.

Figure 24:
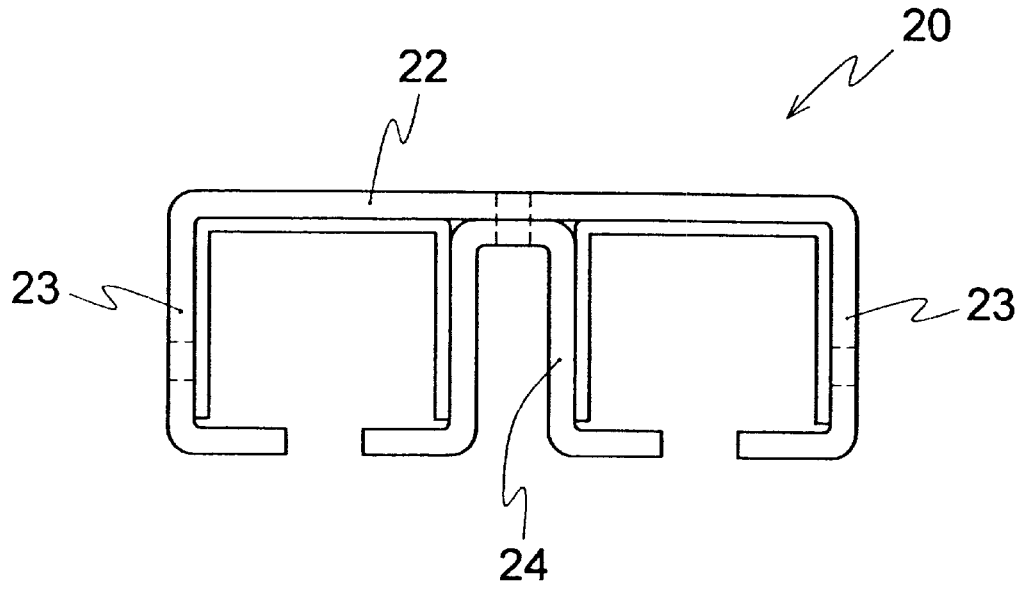
FIG. 24 is a side view showing a large-diameter iron core in the electromagnetic portion.
Figure 25:
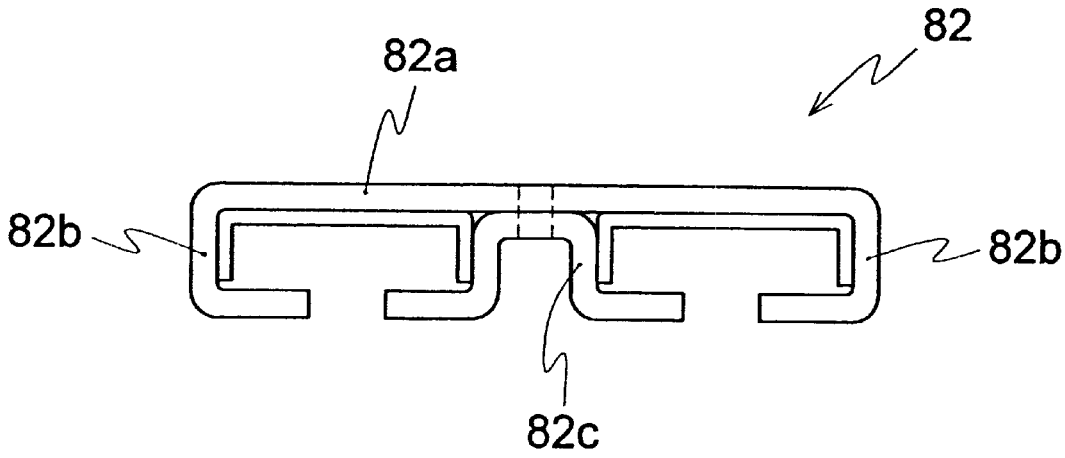
FIG. 25 is a side view showing a small-diameter iron core in the electromagnetic portion.
Figure 26:
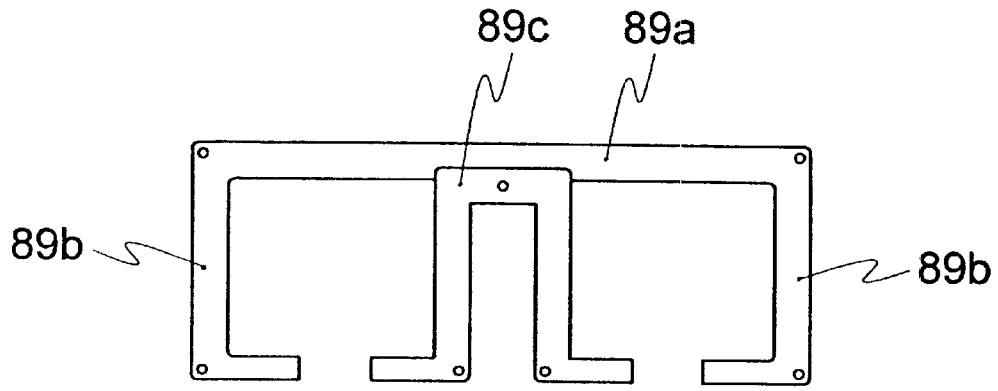
FIG. 26 is a side view showing another large-diameter iron core in the electromagnetic portion.
Figure 27:
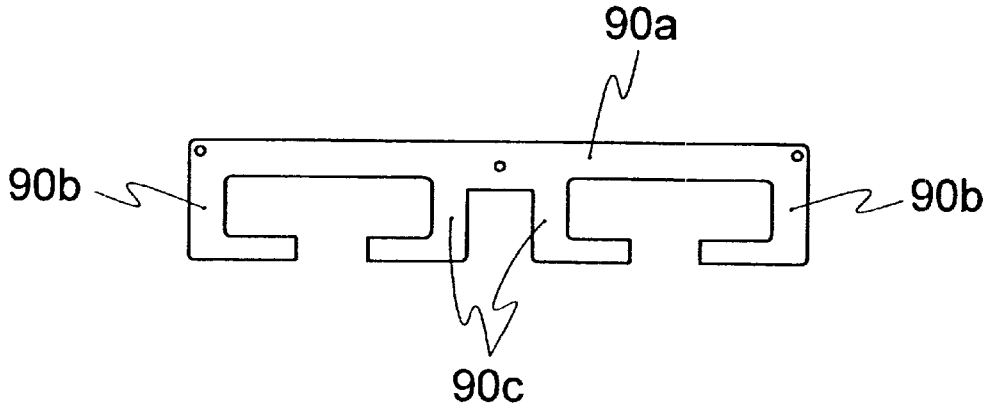
FIG. 27 is a side view showing another small-diameter iron core in the electromagnetic portion.

The large-diameter iron core 20 shown in FIG. 24, which is an iron core having the same E-shaped section as that of FIG. 2, is composed of an outer yoke portion 22, side pole portions 23 disposed on both ends of the outer yoke portion 22, and a a-shape center pole portion 24 disposed between the side pole portions 23. Moreover, the above-mentioned small-diameter iron core 82, which has the same structure as the large-diameter iron core 20 except that it has a different height, is composed of an outer yoke portion 82*a*, side pole portions 82*b* disposed on both ends of the outer yoke portion 82*a*, and a center pole portion 82*c* having a π-shape which is disposed between the side pole portions 82*b*. The above-mentioned outer yoke portions 22 and 82*a* and the side pole portions 23 and 82*b* are integrally formed into one unit by pressing a sheet of steel plate, for example, a silicon steel plate. Here, in the present embodiment, the large-diameter iron core and the small-diameter iron core are formed by assembling bent members produced by pressing steel plates; however, the present invention is not limited to this structure; for example, with respect to the large-diameter iron core, as shown in FIG. 26, a plurality of stator cores made of silicon steel plates, each having side pole portions 89*b* preliminarily formed on both ends of the outer yoke portion 89*a*, are laminated to form a composite member, and a plurality of stator cores made of silicon steel plates, each having the center pole portion 89*c* preliminarily formed therein, are laminated to form another composite member, and these might be formed into an integral part by welding or the like. Moreover, with respect to the small-diameter iron core, as shown in FIG. 27, a plurality of stator cores made of silicon steel, each having the side pole portions 90*b* disposed on both ends of the outer yoke section 90*a* and the center pole portion 90*c* disposed in the center integrally formed therein, might be laminated to form the iron core.

Figure 28:
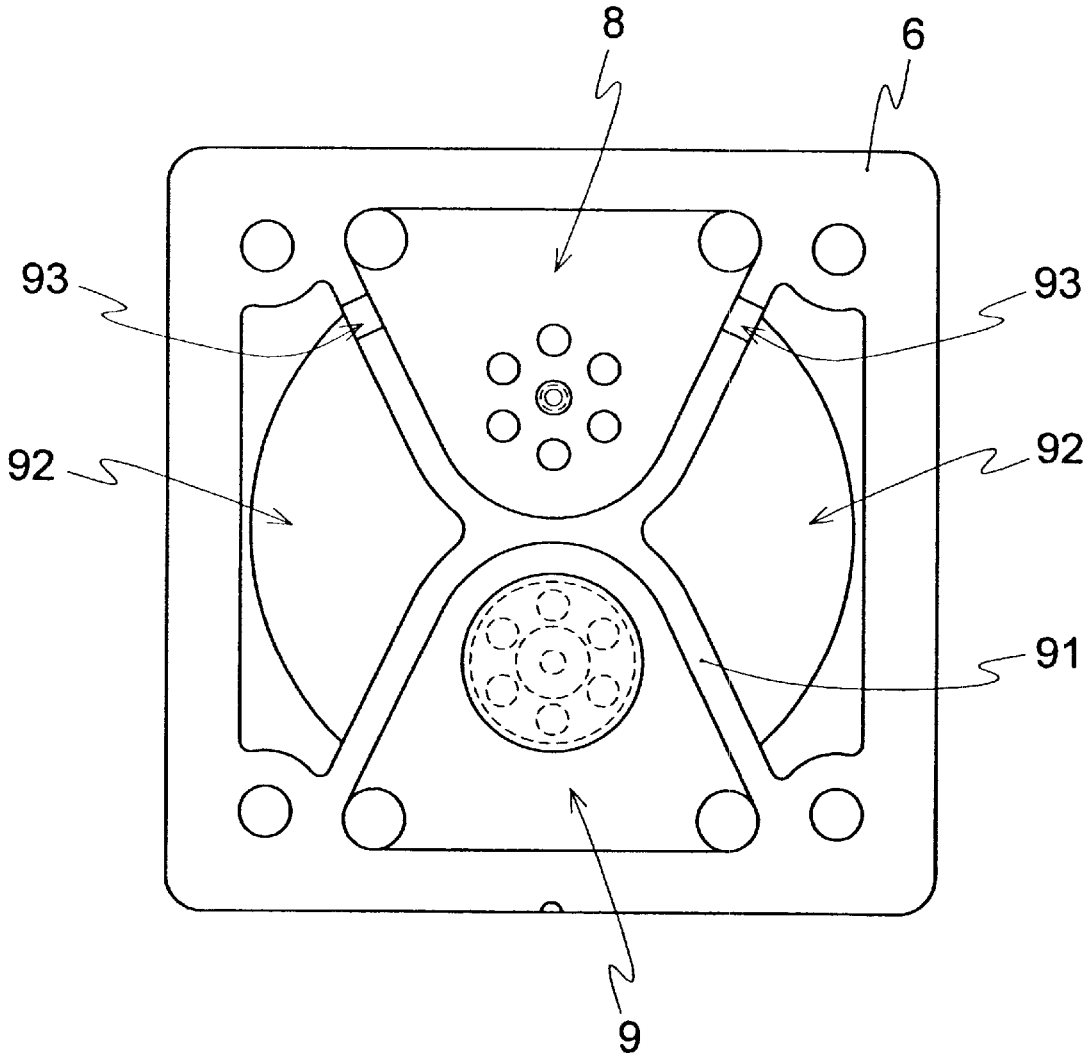
FIG. 28 is a side view showing a pump casing in FIG. 21.
Figure 29:
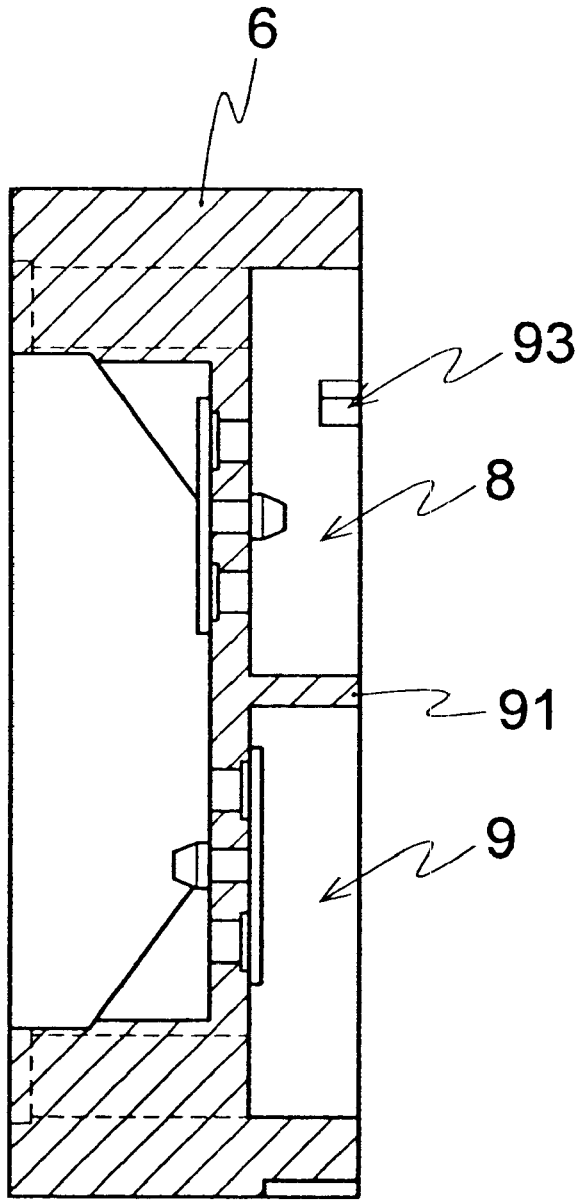
FIG. 29 is a sectional view of the pump casing in FIG. 21.

Here, as shown in FIGS. 28 and 29, in the pump casing 6 in the present embodiment, the suction chamber 8 and the discharge chamber 9 are formed by a virtually X-shaped partition wall 91 at position which are symmetrical in the up and down direction, and cavity sections 92 are formed by the partition wall 91 at positions which are symmetrical in the lateral direction. Moreover, a penetration groove 93 is formed in the partition wall 91 dividing the suction chamber 8 and the right and left cavity sections 92. With respect to the shape of the penetration groove 93, it is not particularly limited, and any shape might be used as long as it allows the groove to communicate with the cavity sections 92; for example, a cut-out groove or hole might be used. Moreover, the number of the penetration grooves 93 is not particularly limited, and is appropriately selected and set.

In the present embodiment, the suction chamber 8 and the right and left cavity sections 92 are connected to each other through one penetration groove 93 so that each of the cavity sections 92 serves as a resonance-type silencer section with respect to suction sound caused by sucked air; that is, the suction sound is absorbed with the frequency f represented by the following equation (1):

$$f = \frac{1}{2\pi}\sqrt{\frac{k}{M}} \tag{1}$$

Here, k represents a spring constant of the cavity section per unit area of the penetration groove, and M represents the mass of the penetration groove per unit area. For example, pumps, which had respectively flow rates of 22.7 liters/min. and 26.0 liters/min at the time of frequencies of 50 Hz and 60 Hz, with a discharge pressure of 10 (kPa), as pump specifications, were prepared, and the noise level (A-characteristic sound pressure level) difference was examined depending on the presence and absence of the penetration groove. Table 1 shows the results of the tests. Table 1 shows that the pump casing having the penetration groove formed therein achieved a reduction of approximately 10 db.

TABLE 1

| f (Hz) | No Penetration Groove (db) | With Penetration Groove (db) |
|---|---|---|
| 50 | 52 | 40.5 |
| 60 | 54 | 42.0 |

Since the cavity section having a silencer function is formed in the pump casing, the pump according to the present embodiment makes it possible to further reduce the suction noise.

Figure 30:
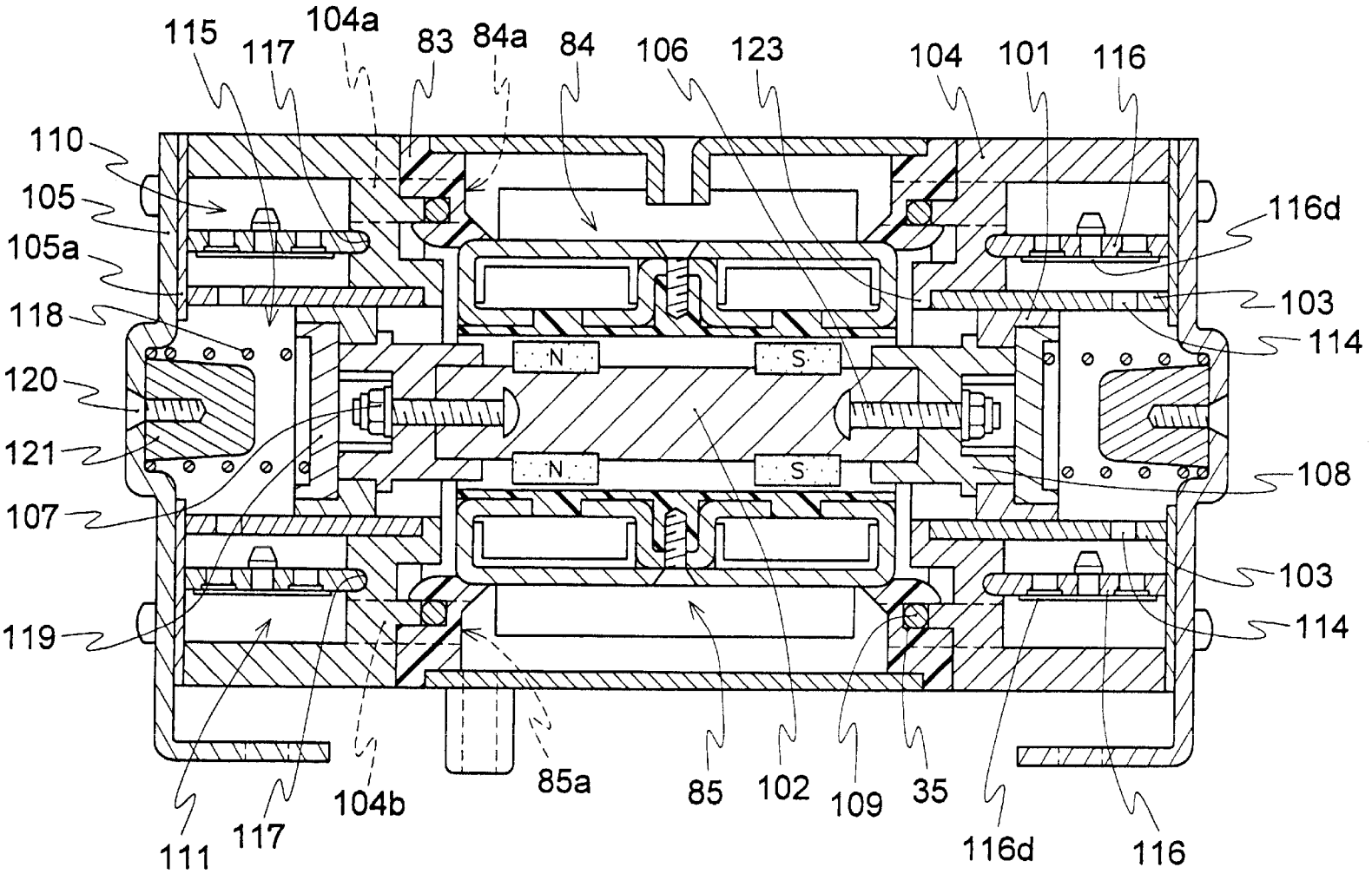
FIG. 30 is a partial sectional view showing yet another embodiment of the electromagnetic oscillating type pump according to the present invention.

The following description will discuss an electromagnetic oscillating type pump according to still another embodiment. As shown in FIG. 30, in the electromagnetic oscillating type pump according to the present embodiment, for example, in order to sharedly use the electromagnet portion 81 having an outer surface on which the frame portion 83 is formed and to reduce the cost of the mold, in place of the oscillator to which a diaphragm of the diaphragm-type electromagnetic oscillating type pump shown in FIG. 21 is connected, an oscillator 102 in which a piston 101 is formed is used, and a lateral surface lids 105 are fixed to the side of the pump portion of the pump casing 104 having a cylinder portion 103 disposed to the inner circumferential portion thereof.

The above-mentioned piston 101 is fitted to the outer circumferential surface of a piston frame 108 inserted through a screw 106 which is fastened to the end of the oscillator 102 and then secured by a nut 107. The material of the piston frame 108 can be appropriately selected. For example, since the oscillator 102 and the pump casing 104 are assembled parts, it is inevitable to have slight errors in the assembling precision, and with respect to the precision in the piston 101 of the oscillator 102, in order to provide smooth sliding on the contact face between the cylinder portion 103 and the piston 101 even in the case of a slight deviation occurring in the concentricity of the right and left cylinder portions 103, a material having a bending property (rubber flexibility) such as EPDM (hardness: 60°) or urethane rubber having the lowest hardness 50° which allows machining, might be used. With respect to the material of the piston frame 108, a hard material such as polyester resin might be used. In this case, in order to provide a bending property to the piston 101, the shape of the piston 101 is formed into, for example, a cup shape with a bottom having a thickness of 0.5 to 0.75 mm, and the outer surface of the outer circumferential edge of the piston, which slides on the cylinder portion, is preferably shaped into a tapered face extending outwards. When such a cup-type piston is used, the piston is fixed with the bottom of the piston being pressed by a cup-pressing member which is fastened to the end surface of the piston frame with screws.

Here, in the present embodiment, the piston 101 is prepared as a separate part from the piston frame 108; however, these might be prepared as an integral part.

Figure 31:
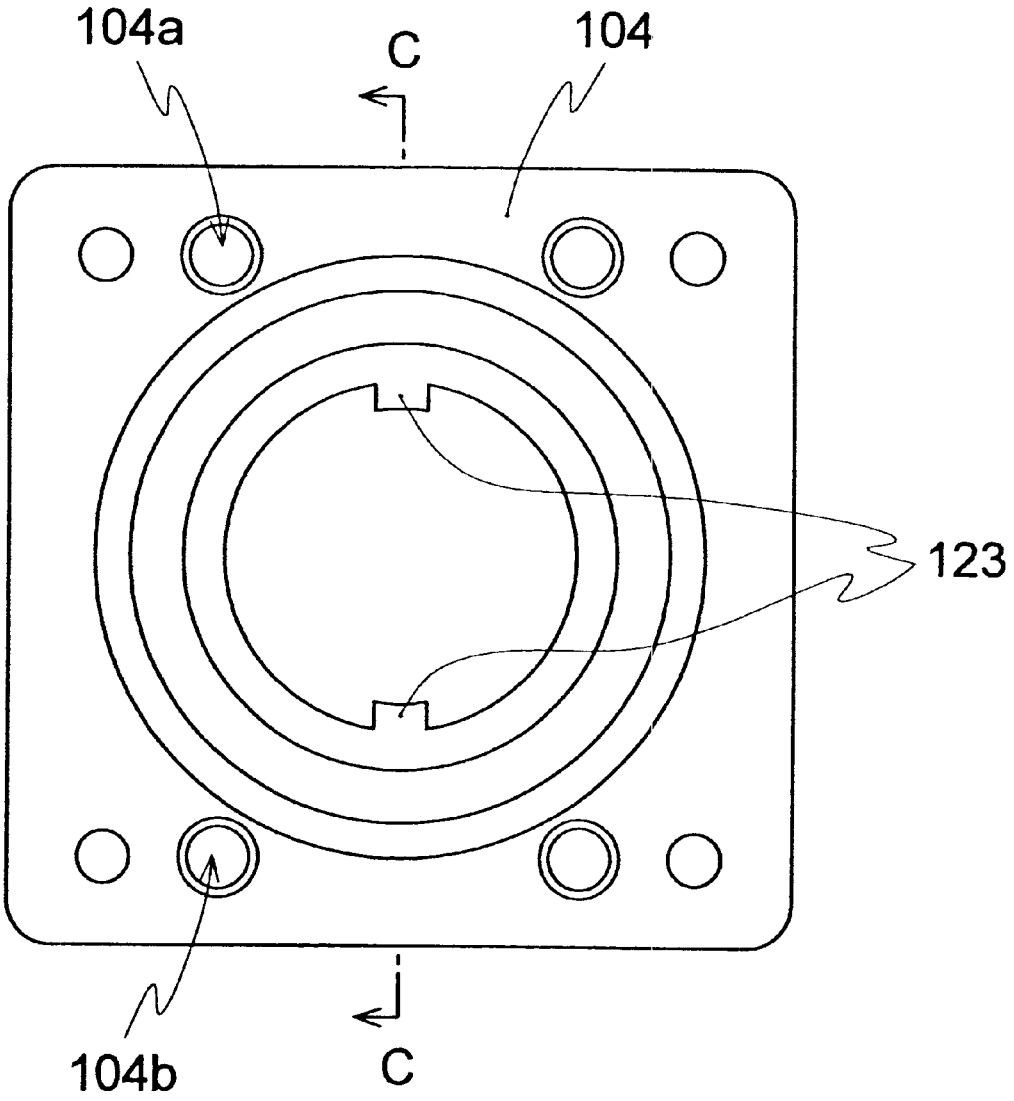
FIG. 31 is a left side view showing the pump casing in FIG. 30.
Figure 32:
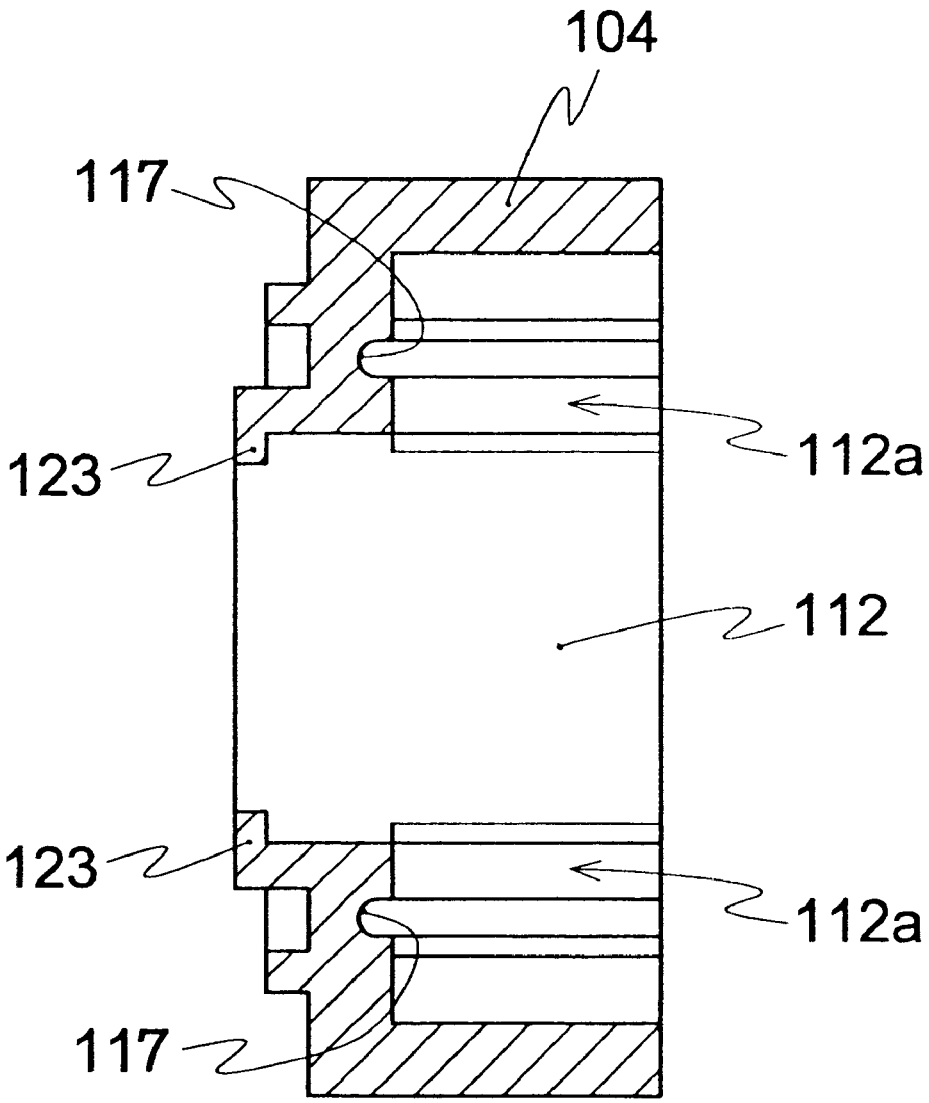
FIG. 32 is a sectional view taken along the line C—C in FIG. 30.

As shown in FIGS. 30 and 31, the pump casing 104 is fixed to the frame portion 83 through an O-ring 109 fitted to the mounting portion 35 of the frame portion 83 in order to seal the inside of the electromagnet portion 2. Since the concave sections 84 and 85 having a silencer function are formed in the frame portion 83, a path 104*a*, which connects to the path 84*a* of the concave section 84 and has an opening in the suction chamber 110 inside the pump casing 104, is formed in the pump casing 104, and a path 104*b*, which connects to the path 85*a* of the concave section 85 and has an opening in the discharge chamber 111 inside the pump casing 104, is also formed therein. As shown in FIGS. 31 to 34, in the present embodiment, the suction chamber 110 and the discharge chamber 111 are allowed to communicate with each other through an opening 112*a* formed by cutting out a portion in the up and down direction of the partition wall 112 formed on the inner circumferential portion, and cavity sections 113 are formed at positions in the lateral direction of the partition wall 112. Therefore, the pump section in the pump casing 104 is composed of the suction chamber 110, the discharge chamber 111, and a compression chamber 115 which communicates therewith through a vent hole 114 of the cylinder portion 103.

Figure 35:
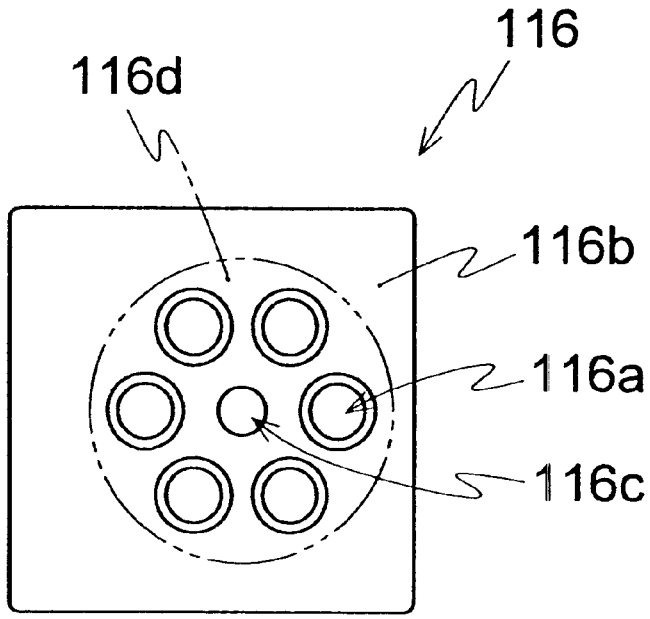
FIG. 35 is a plan view showing a valve seat in FIG. 30.
Figure 36:
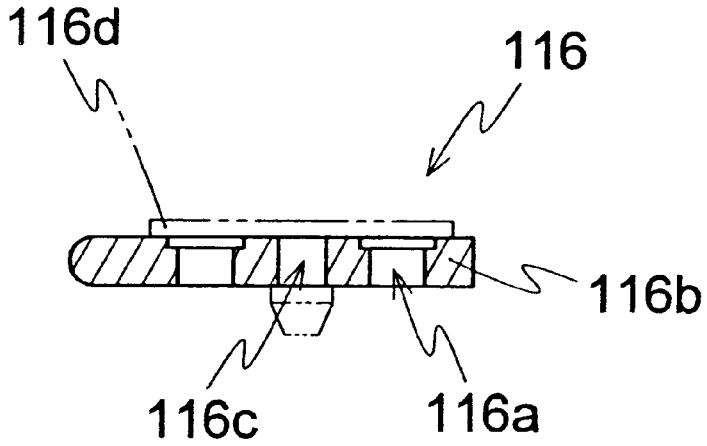
FIG. 36 is a sectional view showing the valve seat in FIG. 35.

On the suction chamber 110 side and on the discharge chamber 111 side, as shown in FIG. 30 and FIGS. 35 to 36, valve bodies 116, each consisting of a plate-shaped valve seat 116*b* having vent holes 116*a* and a valve 116*d* fixed to a center hole 116*c* of the valve seat 116*b*, are respectively fitted to a groove 117 formed in the inner wall portion of the pump casing 104 with the valves 116*d* being oriented in reversed directions from each other. In the compression chamber 115, a spring 118, pressing the oscillator 102 is placed through a spring receiver 119, and the positioning of the spring 118 is carried out by a spacer 121 fixed to a fixing screw 120 which is inserted through a hole in the lateral surface lid 105.

Figure 37:
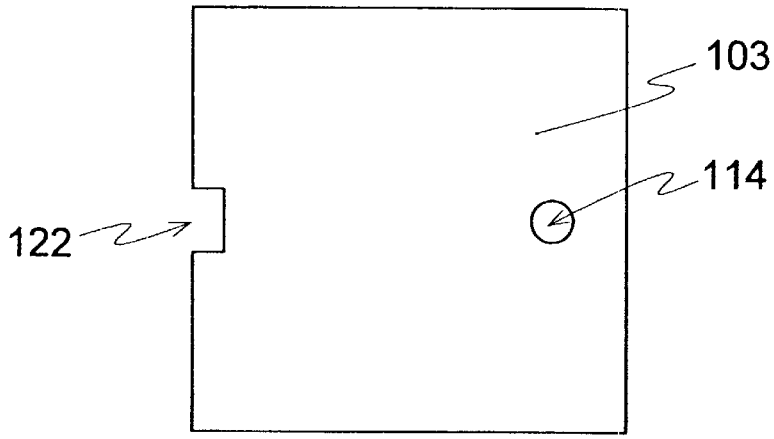
FIG. 37 is a plan view showing a cylinder section in FIG. 30.
Figure 38:
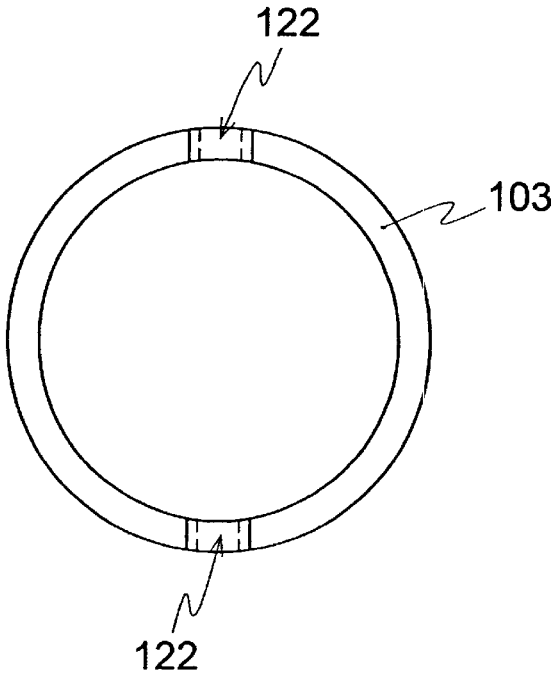
FIG. 38 is a left side view of the cylinder section in FIG. 37.
Figure 39:
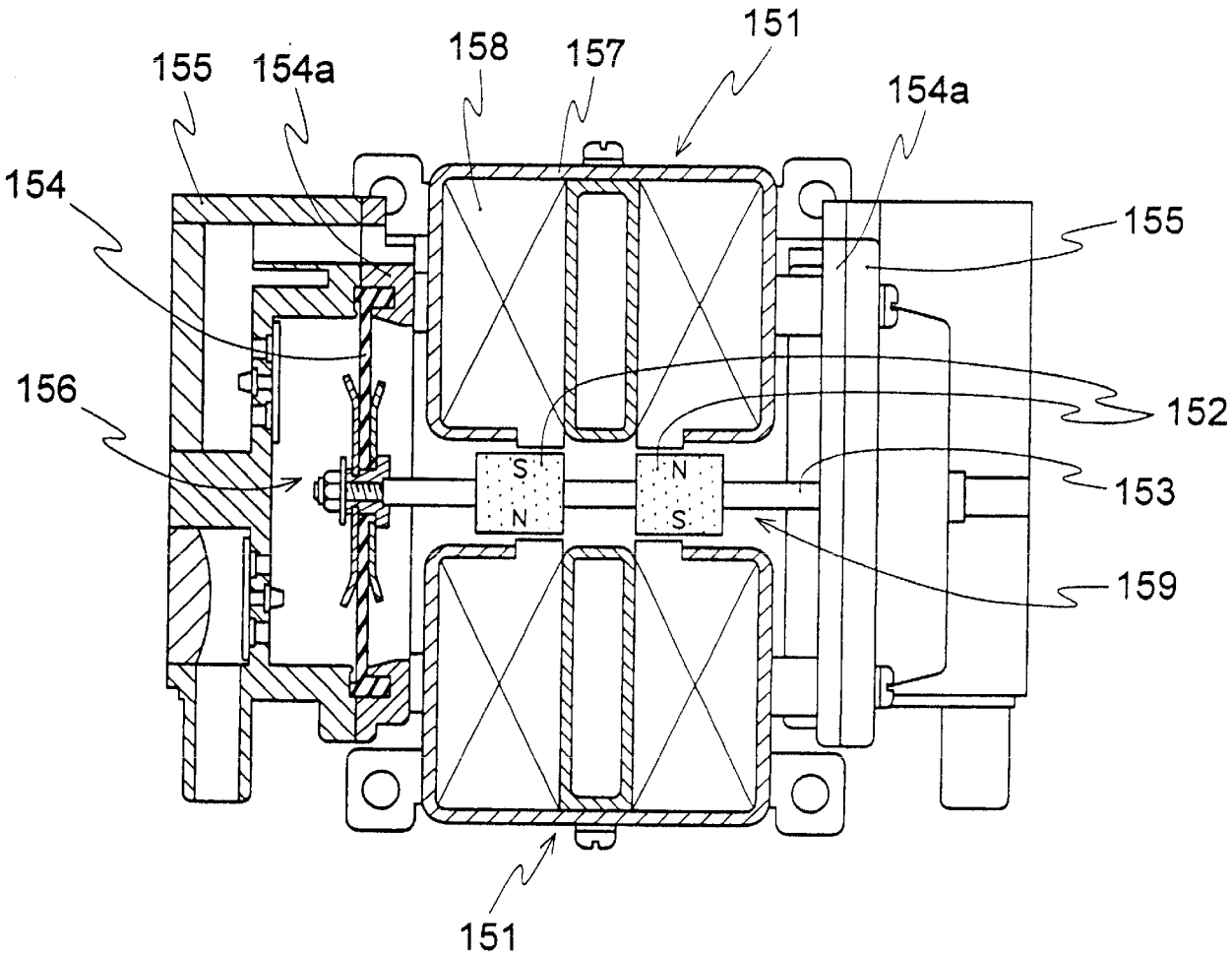
FIG. 39 (Prior Art)
FIG. 39 is a longitudinal sectional view showing one example of a conventional electromagnetic oscillating type pump.
Figure 40:
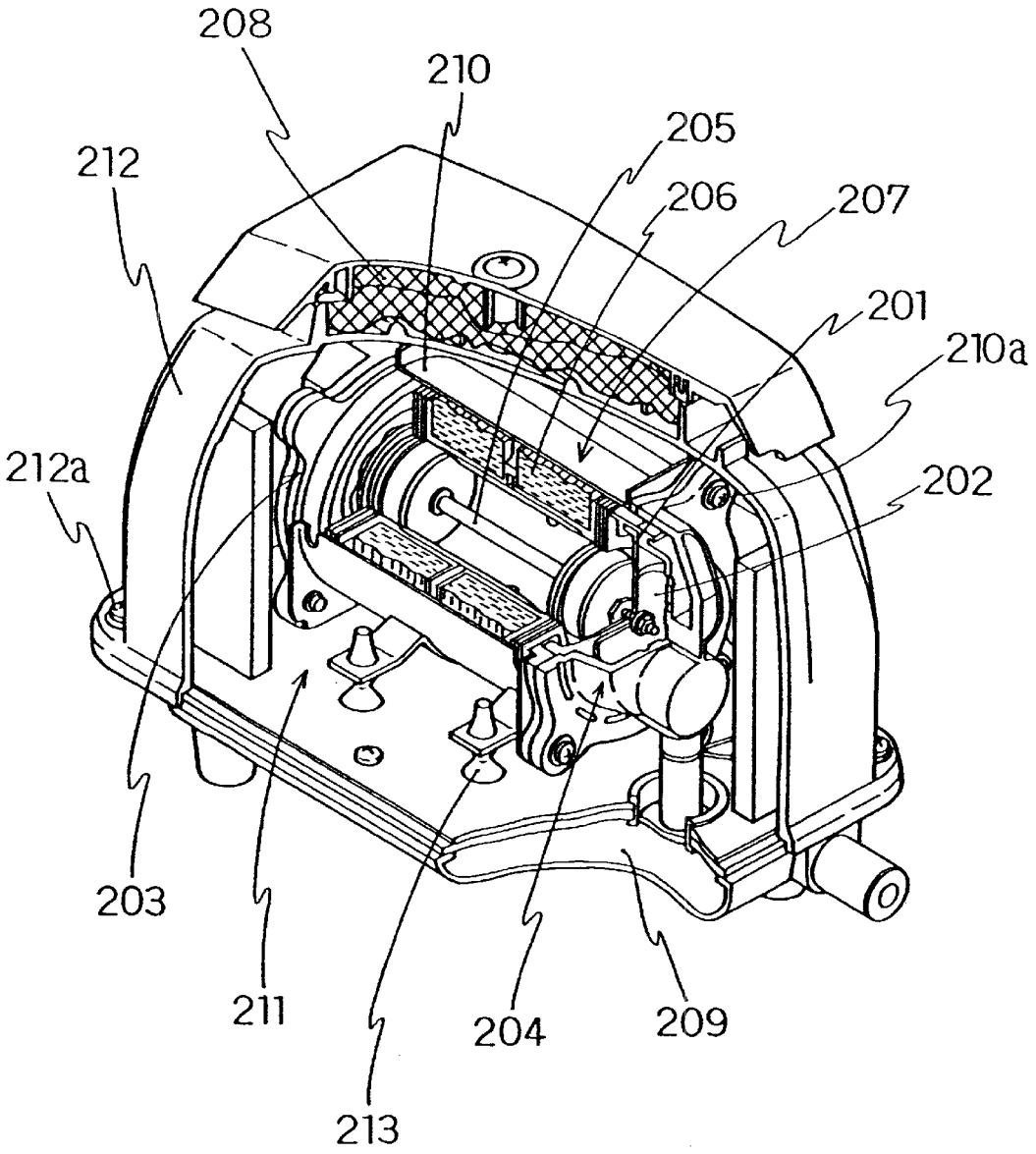
FIG. 40 (Prior Art)
FIG. 40 is a perspective view showing another example of a conventional electromagnetic oscillating type pump.

As shown in FIGS. 37 and 38, the cylinder portion 103 has a cylinder shape to be fitted to the partition wall 112, and cut-out sections 122 are formed on end portions in the same axial direction as the vent hole 114. As shown in FIGS. 30 to 35, upon fitting the cylinder portion 103 into the partition wall 112 of the pump casing 104, the cut-out section 122 is engaged by a protrusion 123 formed at a position in the same axial direction as the formation positions of the suction chamber 110 and the discharge chamber 111 on the inner circumferential surface of the pump casing 104, so that positioning is made so as to place the vent hole 114 on a position of the suction chamber 110 or the discharge chamber 111.

With respect to the cylinder portion 103, although not particularly limited, in order to move the piston 102 smoothly in the cylinder portion 103, a metal material which can be readily machined while easily maintaining the precision in the concentricity, cylindricity and the like is preferable, and among various metal materials, pipes of aluminum or an aluminum alloy which is inexpensive, superior in the self-lubricating property and light-weight, are preferably used.

Here, the valve seat 116*b* in the valve body 116 and the cylinder portion 103 installed in the pump casing 104 might be integrally formed in the pump casing 104. By manufacturing them as separated parts, however, as shown in the present embodiment, it becomes unnecessary upon designing to machine the vent hole penetrating in the radial direction on the inner circumferential portion, thereby reducing the molding cost of the pump casing.

Figure 33:
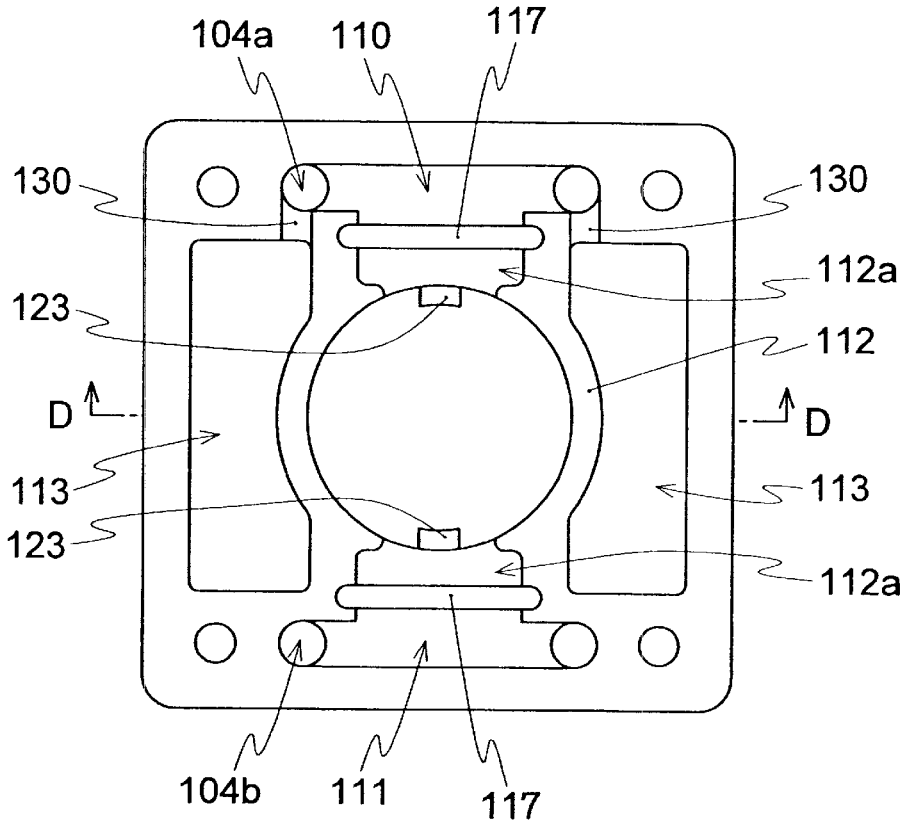
FIG. 33 is a right side view showing the pump casing in FIG. 30.
Figure 34:
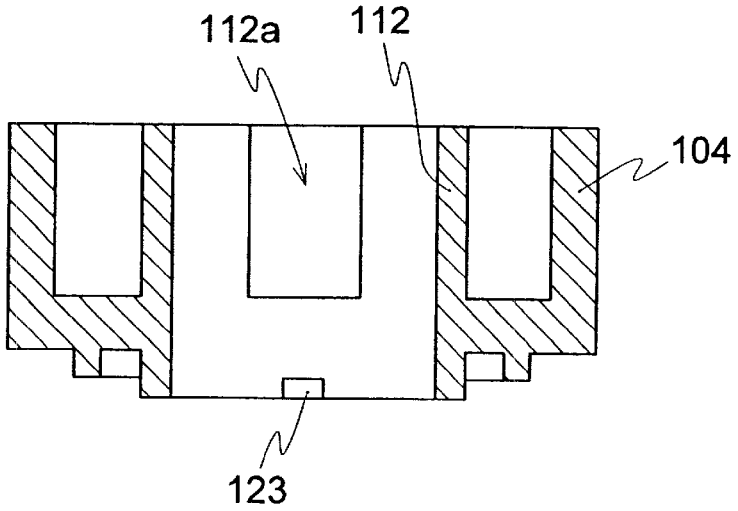
FIG. 34 is a sectional view taken along the line D—D in FIG. 33.

In the electromagnetic oscillating type pump in the present embodiment, the concave section having a silencer function is formed in the frame portion in the diaphragm-type electromagnetic oscillating type pump shown in FIG. 21; however, the present invention is not intended to be limited thereby, and the present invention might be applied to a diaphragm-type electromagnetic oscillating type pump having no silencer in the frame portion, for example, as shown in FIG. 1. In the case where such a pump is used, as shown in FIG. 33, a penetration groove 130 is formed in the partition wall 112 for dividing the suction chamber 110 and the cavity section 113. With this arrangement, since outside air which has been sucked is temporarily stored in the cavity section 113, and then discharged outside, it is possible to reduce discharge noise. Moreover, the application of the frame portion having a silencer function and the pump casing having the penetration groove formed therein to the pump makes it possible to further improve the soundproof effects.

As explained so far, it is possible to obtain electromagnetic oscillating type pumps with the present invention capable of decreasing manufacturing costs and of exhibiting high acoustic insulating effects.

What is claimed is:

1. An electromagnetic oscillating type pump for oscillating diaphragms (5) connected to an oscillator (4), the pump having an electromagnetic portion (2) comprising one or a plurality of iron cores (20) and respective coils (21), the oscillating caused by utilizing magnetic interaction between the electromagnetic portion (2) and a magnetic body (3), wherein a frame portion (19 51 74 83) of resin mold is formed by molding resin on an outer surface of the electromagnetic portion (2) and further wherein the electromagnetic portion (2) comprises an iron core positioning tool (18), for positioning and holding in relative position the one or a plurality of iron cores (20 82) with the respective coils (21), the iron core positioning tool (18) disposed at an inner peripheral portion of the electromagnetic portion (2) so as to be at least partially enclosed by the frame portion (19 51 74 83).

2. The electromagnetic oscillating type pump of claim 1, wherein a coil of wiring assembled in the core within the electromagnetic portion is molded beforehand for enabling insertion of the coil into the core.

3. The electromagnetic oscillating type pump of claim 1, wherein a mounting portion for the diaphragms is integrally formed with the frame portion.

4. The electromagnetic oscillating type pump of claim 3, wherein at least one air tank is integrally formed with the frame portion.

5. The electromagnetic oscillating type pump of claim 1, wherein an acoustic insulating wall for a pump casing to be fixed to both sides of the electromagnetic portion is integrally formed with the frame portion.

6. The electromagnetic oscillating type pump of claim 5, wherein clearance is formed inside of the acoustic insulating wall for the pump casing and inside of a lateral side lid fixedly attached to an end surface of the acoustic insulating wall.

7. The electromagnetic oscillating type pump of claim 1, wherein a tail pipe for a silencer is incorporated within the pump casing fixedly attached to both sides of the electromagnetic portion.

8. The electromagnetic oscillating type pump of claim 1, wherein the plurality of cores of the electromagnetic portion (2) are composed of a pair of large-diameter cores (20 82) and a pair of small-diameter cores (82) differing in height from the large-diameter cores (20), and a concave section (84 85) is formed to the frame portion (83) at a peripheral portion of at least one of the pair of the small-diameter cores (82).

9. The electromagnetic oscillating type pump of claim 1, wherein a suction chamber and a discharge chamber in the pump casing are formed by a partition wall at positions in up and down directions, cavity sections are formed by the partition wall at positions in right and left directions, and a penetration groove is formed in the partition wall dividing the suction chamber and the cavity sections.

10. The electromagnetic oscillating type pump of claim 1, wherein a lateral side lid, which is fixedly attached to a lateral side of a pump portion in the pump casing fixed to both sides of the electromagnetic portion, is made of metal, and a mounting leg is integrally formed with the lateral side lid.

11. The electromagnetic oscillating type pump of claim 1, wherein an oscillator formed with a piston is employed in place of the oscillator to which the diaphragms are connected, and that it further comprises a cylinder portion integrally formed with the electromagnetic portion in place of a mounting portion for the diaphragms.

12. The electromagnetic oscillating type pump of claim 1, wherein an oscillator formed with a piston is employed in place of the oscillator to which the diaphragms are connected, and a cylinder portion is provided at an inner portion of the pump casing.

13. The electromagnetic oscillating type pump of cliam 12, wherein a valve body consisting of a valve seat having a vent hole and a valve is fitted to the suction chamber side and the discharge chamber side in the pump portion of the pump casing.

14. The electromagnetic oscillating type pump of claim 12, wherein a suction chamber and a discharge chamber in the pump casing are formed by a partition wall at positions in up and down directions, cavity sections are formed by the partition wall at positions in right and left directions, and a penetration groove is formed in the partition wall dividing the suction chamber and the cavity sections.

* * * * *

UNITED STATES PATENT AND TRADEMARK OFFICE

CERTIFICATE OF CORRECTION

PATENT NO. : 6,533,560 B2
DATED : March 18, 2003
INVENTOR(S) : Ikuo Ohya and Nozomu Kawasaki It is certified that error appears in the above-identified patent and that said Letters Patent is hereby corrected as shown below:

Column 11,
Line 32, “a-shape” should be -- π shape --.

Column 16,
Line 18, “cliam” should be -- claim --.

Signed and Sealed this

Thirtieth Day of September, 2003

JAMES E. ROGAN
*Director of the United States Patent and Trademark Office*